US007704663B2

(12) United States Patent
Ide

(10) Patent No.: US 7,704,663 B2
(45) **Date of Patent: *Apr. 27, 2010**

(54) IMAGE FORMING METHOD AND IMAGE-FORMING APPARATUS USING THE SAME

(75) Inventor: Osamu Ide, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 807 days.

This patent is subject to a terminal disclaimer.

(21) Appl. No.: 11/402,248

(22) Filed: Apr. 12, 2006

(65) Prior Publication Data

US 2007/0048653 A1 Mar. 1, 2007

(30) Foreign Application Priority Data

Aug. 23, 2005 (JP) ..... 2005-241871
Aug. 23, 2005 (JP) ..... 2005-241876

(51) Int. Cl.
*G03G 15/20* (2006.01)

(52) U.S. Cl. ..... 430/120.1; 430/124.1; 430/126.1

(58) Field of Classification Search ..... 430/120.1, 430/124.1, 126.1
See application file for complete search history.

(56) References Cited

U.S. PATENT DOCUMENTS 5,780,191 A * 7/1998 Ide ..... 430/45.1
2004/0157736 A1* 8/2004 Ide ..... 503/210
2005/0214669 A1* 9/2005 Hayashi et al. ..... 430/109.4

FOREIGN PATENT DOCUMENTS

JP 5-195184 8/1993
JP 2004-20861 1/2004
JP 2005-99123 4/2005

* cited by examiner

*Primary Examiner*—John L Goodrow
(74) *Attorney, Agent, or Firm*—Morgan, Lewis & Bockius LLP

(57) ABSTRACT

An image forming method comprises: supplying an image support onto an imaging site, the image support comprising a substrate, a light-scattering layer containing a white pigment and a first thermoplastic resin comprising a polyolefin-based resin, and a toner-receiving layer containing a second thermoplastic resin comprising a mixture of a crystalline resin and an amorphous resin, in this order, forming a colored toner image on the image support with a colored toner containing a third thermoplastic resin; and forming a transparent toner image on the image support having the colored toner image formed thereon with a transparent toner containing a fourth thermoplastic resin having a glass transition temperature of from not lower than about 50° C. to lower than about 70° C.

28 Claims, 11 Drawing Sheets

FIG. 7

| | COMPOSITION | MOLAR COMPOSITION RATIO | Mw/Mn | Tm |
|---|---|---|---|---|
| A | TPA/ND/BPA | 50/47.5/2.5 | 22000/10900 | 94 |
| B | TPA/ND/BPS | 50/47.5/2.5 | 23000/12000 | 92 |
| C | TPA/ND/BPS | 50/45/5 | 22000/11000 | 90 |
| D | TPA/ND | 50/50 | 24000/13000 | 95 |
| E | TPA/ND/BPA | 50/47.5/2.5 | 43000/22000 | 96 |

FIG. 8

| | COMPOSITION | MOLAR COMPOSITION RATIO | Mw/Mn | Tm |
|---|---|---|---|---|
| F | TPA/ND/BPA | 50/12.5/37.5 | 13000/6000 | 58 |
| G | TPA/ND/BPA | 50/7.5/42.5 | 12000/5600 | 62 |
| H | TPA/BPA | 50/50 | 13000/6000 | 82 |
| I | TPA/BPA/CHDM | 50/40/10 | 13000/6000 | 65 |

FIG. 9

| | MECHANICAL STRENGTH | HEAT RESISTANCE | GLOSS | SMOOTHNESS | GRANULARITY | Y | COMPREHENSIVE IMAGE QUALITY |
|---|---|---|---|---|---|---|---|
| EXAMPLE 1 | G | G | G | F | F | 0.8 | F |
| EXAMPLE 2 | F | G | G | G | F | 1.2 | G |
| EXAMPLE 3 | G | G | G | F | F | 0.7 | F |
| EXAMPLE 4 | G | G | G | G | F | 0.4 | G |
| EXAMPLE 5 | G | F | G | G | F | 0.2 | G |
| EXAMPLE 6 | F | F | G | F | F | 2.5 | F |
| EXAMPLE 7 | G | F | G | G | F | 1.1 | G |
| EXAMPLE 8 | F | G | G | G | F | 1.2 | G |
| EXAMPLE 9 | F | F | G | F | F | 1.3 | F |
| EXAMPLE 10 | F | F | F | F | F | 1.4 | F |
| EXAMPLE 11 | G | F | F | F | F | 0.9 | F |
| EXAMPLE 12 | F | G | G | G | F | 0.5 | G |
| EXAMPLE 13 | G | G | G | F | G | 0.8 | G |
| EXAMPLE 14 | F | G | G | F | G | 0.8 | G |
| EXAMPLE 15 | G | G | G | F | F | 0.8 | F |
| EXAMPLE 16 | G | G | G | F | F | 0.8 | F |

FIG. 10

| | MECHANICAL STRENGTH | HEAT RESISTANCE | GLOSS | SMOOTHNESS | GRANULARITY | Y | COMPREHENSIVE IMAGE QUALITY |
|---|---|---|---|---|---|---|---|
| COMPARATIVE EXAMPLE 1 | G | G | P | P | G | 1.5 | P |
| COMPARATIVE EXAMPLE 2 | G | G | P | P | G | 3.5 | P |
| COMPARATIVE EXAMPLE 3 | G | G | P | P | P | 3.0 | P |
| COMPARATIVE EXAMPLE 4 | P | G | P | P | P | 0.3 | P |
| COMPARATIVE EXAMPLE 5 | G | G | G | P | P | - | P |
| COMPARATIVE EXAMPLE 6 | G | G | P | P | P | - | P |
| COMPARATIVE EXAMPLE 7 | G | G | P | P | F | - | P |
| COMPARATIVE EXAMPLE 8 | G | G | P | P | F | 0.8 | P |
| COMPARATIVE EXAMPLE 9 | P | F | G | G | P | 0.8 | P |
| COMPARATIVE EXAMPLE 10 | G | G | P | P | P | 0.8 | P |

FIG. 11

| | CONVEYABILITY | HEAT RESISTANCE | SMOOTHNESS | GRANULARITY | COMPREHENSIVE IMAGE QUALITY |
|---|---|---|---|---|---|
| EXAMPLE 17 | G | G | F | F | G |
| EXAMPLE 18 | G | F | G | F | G |
| EXAMPLE 19 | G | G | F | F | G |
| EXAMPLE 20 | G | F | G | G | G |
| EXAMPLE 21 | G | G | F | F | F |
| COMPARATIVE EXAMPLE 11 | G | G | P | F | P |
| COMPARATIVE EXAMPLE 12 | G | F | P | P | P |
| COMPARATIVE EXAMPLE 13 | G | F | G | P | P |
| COMPARATIVE EXAMPLE 14 | G | G | P | P | P |
| COMPARATIVE EXAMPLE 15 | P | F | G | G | G |

IMAGE FORMING METHOD AND IMAGE-FORMING APPARATUS USING THE SAME

BACKGROUND

1. Technical Field

The present invention relates to the configuration of an image formed by an imaging apparatus such as copying machine and printer and particularly to an image forming method effective for the formation of a color image using an electrophotographic method or the like and an image-forming apparatus using same.

2. Related Art

This type of color image-forming apparatus has heretofore employed the following imaging steps to form a color image taking an embodiment using electrophotographic process as an example.

In some detail, light reflected by an original when irradiated with light is subjected to color separation by a color scanner. The color data thus obtained are subjected to image processing and color correction by an image processor to obtain a plurality of color image signals which are each then modulated by a semiconductor laser or the like to generate laser beams. These laser beams are each applied to an image carrier made of an inorganic photoreceptor such as selenium and amorphous silicon or an organic photoreceptor comprising a phthalocyanine pigment, bisazo pigment or the like as a charge-generating layer by plural times to form a plurality of electrostatic latent images. These electrostatic latent images are then sequentially developed with charged Y (yellow), M (magenta), C (cyan) and K (black) color toners. The toner images thus developed are then separately or altogether transferred from the image carrier made of an inorganic or organic photoreceptor onto an image support such as paper on which they are then fixed by a fixing unit of heat pressing fixing type. In this manner, a color image is formed on the image support.

In the aforementioned case, the color toner comprises an inorganic particulate material such as particulate silicon oxide, titanium and aluminum oxide or organic particulate material such as particulate PMMA and PVDF having an average particle diameter of from about 5 nm to 100 nm attached to a particulate material having an average particle diameter of from 1 μm to 15 μm having a colorant dispersed in a thermoplastic resin such as polyester resin, styrene-acryl copolymer and styrene-butadiene copolymer.

Examples of the colorant to be dispersed in the thermoplastic resin include benzidine yellow, quinoline yellow and Hansa yellow as Y (yellow) colorant, Rhodamine B, rose Bengal and pigment red as M (magenta) colorant, phthalocyanine blue, aniline blue and pigment blue as C (cyan) colorant, and carbon black, aniline black and blend of color pigments as K (black) colorant.

As the image support there has been heretofore used ordinary paper mainly composed of pulp material, coated paper obtained by spreading a resin mixed with a white pigment or the like over ordinary paper, white film made of a resin such as polyester mixed with a white pigment or the like.

On the other hand, as the transferring step there has been known a process which comprises previously allowing the image support to be adsorbed to a transferring roll or transferring belt composed of a dielectric material or the like provided opposed to an image carrier, and then applying a bias to the transferring roll or providing a predetermined transferring member (e.g., transferring corotoron, biased transferring roll or biased transferring brush) on the back side of the transferring belt, whereby an electric field having a polarity opposite that of the charge of the toner is given to the back side of the transferring roll or transferring belt so that the toner images are sequentially electrostatically transferred onto the image support.

As the transferring step there has been known also a process which comprises giving an electric field having a polarity opposite that of the charge of the toners to the back side of a belt-shaped intermediate transferring material composed of a dielectric material or the like provided opposed to the image carrier using a predetermined primary transferring member (e.g., transferring corotoron, biased transferring roll or biased transferring brush) so that the toner images formed on the image carrier are separately transferred onto the intermediate transferring material to form a multi-layer toner image thereon, and then giving an electric field having a polarity opposite that of the charge of the toners to the back side of the image support using a predetermined secondary transferring member (e.g., transferring corotoron, biased transferring roll or biased transferring brush) so that the toner images thus superposed on each other are electrostatically transferred onto the image support at once.

Further, as the fixing step there has been known, e.g., a heat pressing fixing process which comprises passing an image support onto which toner images have been transferred through the gap between a pair of fixing rolls having a heat source such as incandescent lamp incorporated therein disposed in pressure contact with each other so that the toners are heat-melted and fixed on the image support or a cooling/peeling fixing process which comprises passing an image support onto which toner images have been transferred with a fixing belt superposed thereon through the gap between a pair of fixing rolls disposed opposed to each other with the fixing belt interposed therebetween, the fixing belt having a release layer such as silicone resin layer formed thereon, extending over a plurality of tension rolls and comprising a heat source such as incandescent lamp incorporated therein, so that the toner images are heat-pressed and fixed, and then separating the toner images from the fixing belt after cooling so that the toner images are fixed on the image support.

It has been known that the latter fixing process is suitable particularly for the formation of an image having a gloss as high as that of silver salt photographic prints. Further, when the latter fixing process is used in combination with the aforementioned image support having a thermoplastic resin layer provided thereon, a uniformly high gloss can be obtained regardless of image density.

When as the base to be incorporated in the image support having a thermoplastic resin layer provided thereon there is used a white PET film or coated paper, the resulting image quality is good, but the image support itself is expensive. On the other hand, when inexpensive ordinary paper is used as a base, a technical problem arises that a good image quality cannot be obtained.

Further, when the thermoplastic resin is mainly composed of an amorphous polyester resin such as polyester-based resin, polystyrene-based resin and acrylic resin, a technical problem arises that all the requirements for low temperature fixability, heat resistance and mechanical strength cannot be satisfied at the same time.

In other words, taking into account the reduction of consumption of energy in the formation of image, low temperature fixability is essential. In order to satisfy the low temperature fixability, it is an effective solution to reduce the molecular weight of the resin or lower the glass transition point of the resin.

On the other hand, when an image having a smooth surface as photographic print is stored in automobiles or warehouses or allowed to stand in high temperature atmosphere during the transportation at the bottom of ship with the surface of an image superposed on the back surface of another, the surface of two images superposed on each other or the surface of an image superposed on an album material, it is likely that blocking can occur at the contact site.

In this case, in order to improve durability at high temperatures, i.e., heat resistance, it is effective to raise the glass transition point or molecular weight of the resin itself.

Further, the enhancement of resistance of image to folding, i.e., mechanical strength, too, is an important assignment. In order to enhance the mechanical strength, it is an effective solution to raise the molecular weight of the resin.

Thus, the enhancement of mechanical strength and heat resistance and the improvement of low temperature fixability are opposing assignments. In particular, in order to form an image having a gloss as high as that of silver salt photograph, it is necessary that the fixing temperature be raised. Therefore, it is more difficult to satisfy all the three requirements.

SUMMARY

The present invention has been made in view of above circumstances and provides an image forming method and an image-forming apparatus.

According to an aspect of the invention, An image forming method comprises: supplying an image support onto an imaging site, the image support comprising: a substrate; a light-scattering layer containing a white pigment and a first thermoplastic resin comprising a polyolefin-based resin; and a toner-receiving layer containing a second thermoplastic resin comprising a mixture of a crystalline resin and an amorphous resin, in this order; forming a colored toner image on the image support with a colored toner containing a third thermoplastic resin; and forming a transparent toner image on the image support having the colored toner image formed thereon with a transparent toner containing a fourth thermoplastic resin having a glass transition temperature of from not lower than about 50° C. to lower than about 70° C.

According to another aspect of the invention, an image-forming apparatus comprises: an image support that comprises: a substrate; a light-scattering layer containing a white pigment and a first thermoplastic resin comprising a polyolefin-based resin; and a toner-receiving layer containing a second thermoplastic resin comprising a mixture of a crystalline resin and an amorphous resin, in this order; a colored toner imaging unit that forms a colored toner image on the image support with a colored toner containing a third thermoplastic resin; and a transparent toner imaging unit that forms a transparent toner image on the image support having the colored toner image formed thereon with a transparent toner comprising a fourth thermoplastic resin having a glass transition temperature of from not lower than about 50° C. to lower than about 70° C.

According to another aspect of the invention, an image forming method comprises: supplying an image support onto an imaging site, the image support comprising: a substrate; a light-scattering layer containing a white pigment and a first thermoplastic resin comprising a polyolefin-based resin; and a toner-receiving layer comprising a fifth thermoplastic resin that comprises an amorphous resin as a main component and has a glass transition temperature of 50° C. or more, in this order; forming a colored toner image on the image support with a colored toner containing a third thermoplastic resin; and forming a transparent toner image on the image support having the colored toner image formed thereon with a transparent toner containing a fourth thermoplastic resin having a glass transition temperature of from not lower than about 50° C. to lower than about 70° C.

According to another aspect of the invention, an image-forming apparatus comprising: an image support that comprises: a substrate; a light-scattering layer containing a white pigment and a first thermoplastic resin comprising a polyolefin-based resin; and a toner-receiving layer comprising a fifth thermoplastic resin that comprises an amorphous resin as a main component and has a glass transition temperature of about 50° C. or more, in this order; a colored toner imaging unit that forms a colored toner image on the image support with a colored toner containing a third thermoplastic resin; and a transparent toner imaging unit that forms a transparent toner image on the image support having the colored toner image formed thereon with a transparent toner containing a fourth thermoplastic resin having a glass transition temperature of from not lower than about 50° C. to lower than about 70° C.

BRIEF DESCRIPTION OF THE DRAWINGS

FIG. 7 is a diagram illustrating the crystalline polyester resins A to E of the color toner-receiving layer to be used in Examples 1 to 16 and Comparative Examples 1 to 10;

FIG. 8 is a diagram illustrating the amorphous polyester resins F to I of the color toner-receiving layer to be used in Examples 1 to 16 and Comparative Examples 1 to 10;

FIG. 9 is a diagram illustrating the results of evaluation of properties of Examples 1 to 16;

FIG. 10 is a diagram illustrating the results of evaluation of properties of comparative Examples 1 to 10; and FIG. 11 is a diagram illustrating the results of evaluation of properties of Examples 17 to 21 and Comparative Examples 11 to 15.

DETAILED DESCRIPTION

The invention will be further described in the following embodiments shown in the attached drawings.

Figure 3:
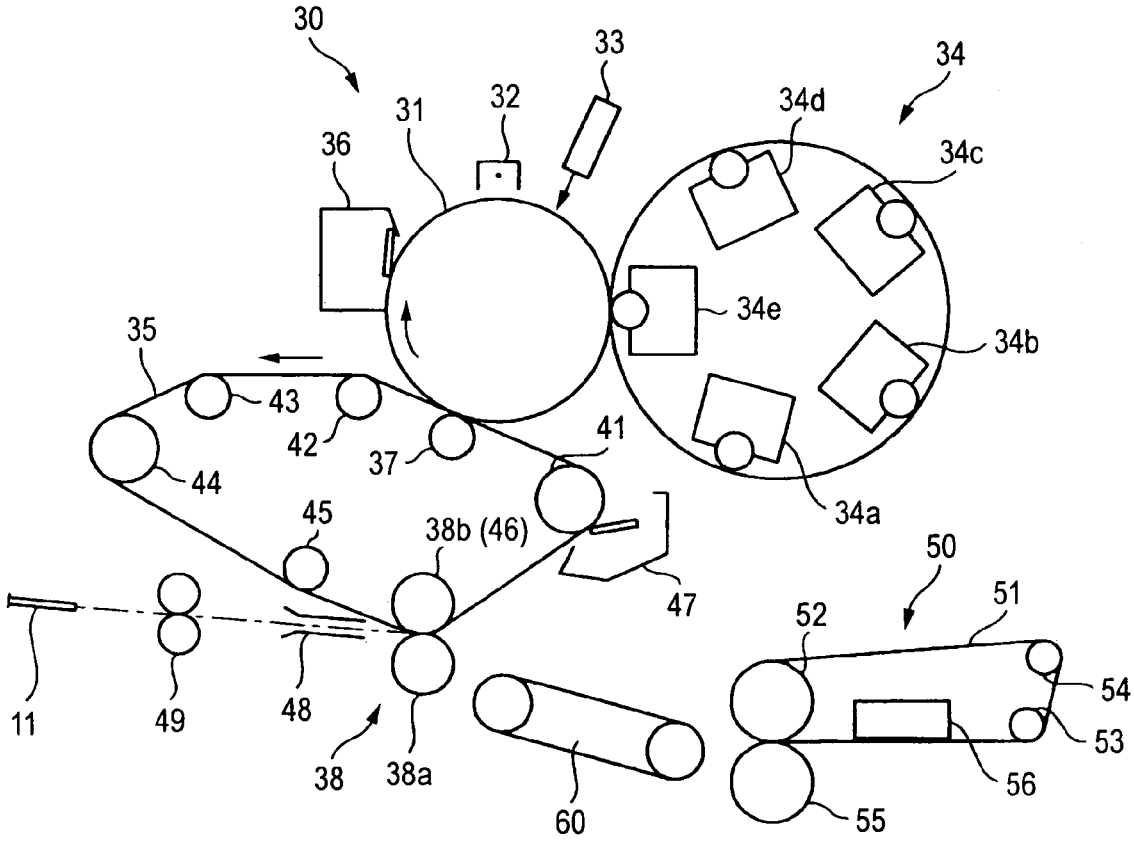
FIG. 3 is a diagram illustrating the entire configuration of the image-forming apparatus according to an embodiment of implementation of the invention.

FIG. 3 depicts an embodiment of the color image-forming apparatus to which the invention is applied.

In FIG. 3, the color image-forming apparatus according to the present embodiment comprises an imaging unit 30 for forming color toner images composed of, e.g., yellow, magenta, cyan and black color components and a transparent toner image on an image support 11, a fixing unit 50 for fixing the color toner images and the transparent toner image formed on the image support 11 by the imaging unit 30 and a conveying unit 60 for conveying the image support 11 onto the fixing unit 50.

Figure 4:
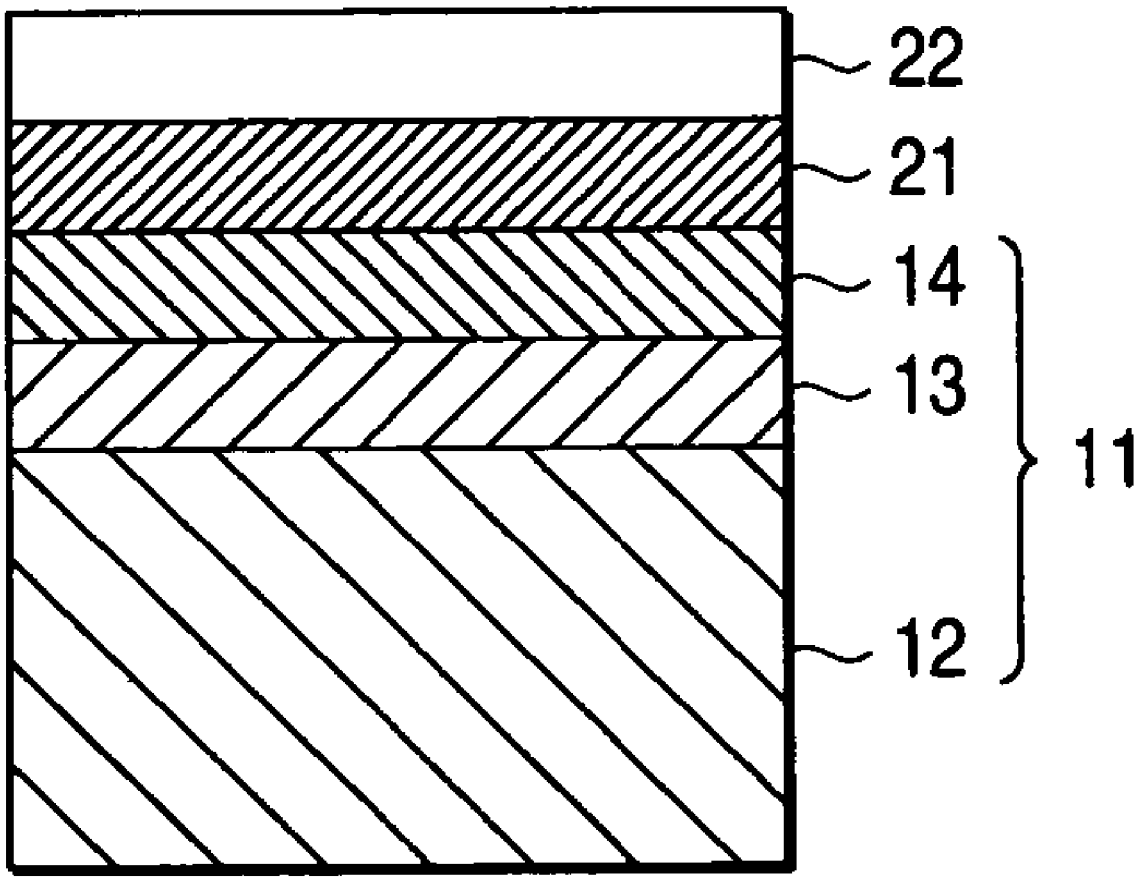
FIG. 4 is a diagram illustrating a section of the image structure to be used in an embodiment of implementation of the invention.

In the present embodiment, the image support 11 comprises on a raw paper 12 at least a light-scattering layer 13 made of a thermoplastic resin layer having a thickness of from 20 μm to 50 μm comprising a white pigment dispersed therein in an amount of from 20 to 40% by weight and a toner-receiving layer 14 having a thickness of from 5 μm to 20 μm containing at least a thermoplastic resin in an amount of 80% by weight or more provided on the light-scattering layer 13 as shown in FIG. 4.

The raw paper 12 is selected from materials having a basis weight of from 100 to 250 gsm commonly used in photographic paper. In some detail, a raw paper optionally having a filler such as clay, talc, calcium carbonate and particulate urea resin, a size such as rosin, alkyl ketone dimer, higher aliphatic acid, epoxy aliphatic acid amide, paraffin wax and alkenylsuccinic acid, paper strength increaser such as starch, polyamide polyamine epichlorohydrin and polyacrylamide and fixing agent such as aluminum sulfate and cationic polymer incorporated in a main raw material such as natural pulp selected from conifer pulp and broadleaf pulp and synthetic pulp may be used.

The raw paper 12 is preferably subjected to thermal and pressure treatment using an apparatus such as machine calendar and super calendar for the purpose of providing smoothness and flatness.

In order to form the raw paper 12 and the light-scattering layer 13, the raw paper 12 is preferably subjected to pretreatment such as glow discharge, corona discharge, flame treatment and anchor coating on the surface thereof from the standpoint of enhancement of adhesion of light-scattering layer 13 to raw paper 12.

Further, as the white pigment to be incorporated in the light-scattering layer 13 there may be used any known white pigment such as titanium oxide, calcium carbonate and barium sulfate. From the standpoint of enhancement of whiteness, the white pigment is preferably mainly composed of titanium oxide.

Moreover, the light-scattering layer 13 comprises a white pigment incorporated therein in an amount of at least 20 to 40% by weight. When the amount of the white pigment falls below 20% by weight, it is disadvantageous in that the resulting light-scattering layer exhibits a low whiteness and is subject to offset when letters are written or printed on the back side thereof. On the contrary, when the amount of the white pigment exceeds 40% by weight, the resulting light-scattering layer 13 lacks mechanical strength and can be difficulty provided with a smooth surface to disadvantage.

Further, the thermoplastic resin to be incorporated in the light-scattering layer 13 is made of a polyolefin-based resin or polyolefin-based copolymer. Examples of the polyolefin-based resin or polyolefin-based copolymer include low density polyethylenes, high density polyethylenes, polypropylenes, ethylene-acrylic acid copolymers, ethylene-acrylic acid ester copolymers, and ethylene-vinyl acetate copolymers.

The viscosity of the thermoplastic resin to be incorporated in the light-scattering layer 13 at the highest ultimate temperature (upper limit of fixing temperature) of the fixing unit 50 is $5\times10^3$ Pa·s or more. When this requirement is satisfied, it is not likely that air bubbles of water vapor generated from the raw paper 12 during fixing can pass through the light-scattering layer 13 and then scatter from the surface of the image, impairing the smoothness of the surface of the image.

Further, the thickness of the light-scattering layer 13 in the present embodiment is preferably from 20 to 50 μm. When the thickness of the light-scattering layer 13 falls below 20 μm, it is disadvantageous in that the light-scattering layer 13 is subject to offset when letters are written or printed on the back side thereof. On the contrary, when the thickness of the light-scattering layer 13 exceeds 50 μm, it is disadvantageous in that when folded, the resulting light-scattering layer 13 can crack.

Further, the light-scattering layer 13 preferably comprises a fluorescent brightening agent incorporated therein which absorbs ultraviolet rays to emit fluorescence. The resulting image support 11 exhibits a high whiteness and thus can provide a sharp color image.

The method of mixing the resin, white pigment and other additives constituting the light-scattering layer 13 doesn't need to be specifically limited so far as the purpose of uniformly dispersing the white pigment and other additives in the resin can be accomplished. For example, any method such as method which comprises charging these components directly into the extrusion type kneader during the spreading of the light-scattering layer 13 by melt-kneading and method which comprises charging a mater pellet previously formed into the melt extruder may be used.

The method of spreading the light-scattering layer 13 doesn't need to be specifically limited so far as the purpose of forming a uniform and smooth light-scattering layer 13 can be accomplished. For example, an apparatus based on a melt extrusion method also capable of dispersing the white pigment and other additives uniformly in the resin may be proposed. The melt extrusion method may involve a lamination method which comprises allowing a molten resin film extruded from a heated extruder through a wide slit die (so-called T-die) to come in contact with the raw paper 12 to which it is then continuously pressure-bonded over rollers or a method which comprises extruding the molten resin film onto a cooling roll on which it is then wound up to form a film. In accordance with this melt-extrusion method, a uniform film made of the aforementioned resin, white pigment and other additives can be easily formed on the raw paper 12. The extruder to be used in the formation of transferred layer by melt-extrusion method may be either monoaxial or biaxial but essentially should be capable of uniformly mixing the white pigment and other additives in the resin.

The light-scattering layer 13 thus spread is preferably subjected to treatment such as flame treatment, corona treatment and plasma treatment on one or both sides of the molten resin film extruded through slit die (T-die). In this manner, the adhesion between the raw paper 12 and the color toner-receiving layer (toner-receiving layer) 14 described later can be improved.

In the present embodiment, the image support 11 comprises a color toner-receiving layer 14 provided on the light-scattering layer 13.

The color toner-receiving layer 14 of the present embodiment comprises: a thermoplastic resin made of a mixture of a crystalline resin and an amorphous resin; or a thermoplastic resin that comprises an amorphous resin as a main component and has a glass transition temperature of 50° C. or more.

The thermoplastic resin of the color toner-receiving layer 14 is made of a resin obtained by melt-mixing a crystalline polyester resin and an amorphous polyester resin. A single crystalline polyester resin may be used. However, a plurality of different crystalline polyester resins may be used in admixture. Similarly, a single amorphous polyester resin may be used. However, a plurality of different amorphous polyester resins may be used in admixture.

In the present embodiment using the thermoplastic resin made of a mixture of a crystalline resin and an amorphous resin, the viscosity of the color toner-receiving layer 14 at the highest ultimate temperature of the fixing unit 50 (corresponding to the upper limit of fixing temperature) is preferably $10^3$ Pa·s or less. When the viscosity of the color toner-receiving layer 14 falls outside the above defined range, the resulting image can be provided with a smooth and gloss surface after fixing. In particular, it is disadvantageous in that steps remain on the border of high density area with low density area even on the fixed image surface. It is also disadvantageous in that the expansion of color toner image (dot gain) at the fixing step becomes remarkable, impairing granularity.

Further, in the present embodiment, the thickness of the color toner-receiving layer 14 preferably falls within a range of from 5 to 20 μm. When the thickness of the color toner-receiving layer 14 falls below 5 μm, the resulting image cannot be provided with a smooth and gloss surface after fixing. In particular, it is disadvantageous in that steps remain on the border of high density area with low density area even on the fixed image surface. On the contrary, when the thickness of the color toner-receiving layer 14 exceeds 20 μm, the resulting color toner-receiving layer 14 can crack when folded to disadvantage.

Moreover, the thermoplastic resin in the color toner-receiving layer 14 in the present embodiment is predetermined such that the weight ratio of the crystalline polyester resin to the amorphous polyester resin is from 35:65 to 65:35.

The thermoplastic resin to be incorporated in the color toner-receiving layer 14 is made of a thermoplastic resin mainly composed of an amorphous resin having a glass transition point of not lower than 50° C. As such an amorphous resin there is preferably used an amorphous polyester resin from the standpoint of assurance of desired heat resistance and smoothness.

In the present embodiment using the thermoplastic resin that comprises an amorphous resin as a main component and has a glass transition temperature of 50° C. or more, the viscosity of the color toner-receiving layer 14 at the highest ultimate temperature of the fixing unit 40 is preferably $10^4$ Pa·s or less. When the viscosity of the color toner-receiving layer 14 falls outside the above defined range, the resulting image can be provided with a smooth and gloss surface after fixing. In particular, it is disadvantageous in that steps remain on the border of high density area with low density area even on the fixed image surface. It is also disadvantageous in that the expansion of color toner image (dot gain) at the fixing step becomes remarkable, impairing granularity.

Further, in the present embodiment, the thickness of the color toner-receiving layer 14 preferably falls within a range of from 5 to 20 μm. When the thickness of the color toner-receiving layer 14 falls below 5 μm, the resulting image cannot be provided with a smooth and gloss surface after fixing. In particular, it is disadvantageous in that steps remain on the border of high density area with low density area even on the fixed image surface. On the contrary, when the thickness of the color toner-receiving layer 14 exceeds 20 μm, the resulting color toner-receiving layer 14 can crack when folded to disadvantage.

In the present embodiment, the measurement of luminous reflectance Y described above is conducted as shown in FIG. 5.

Figure 5:
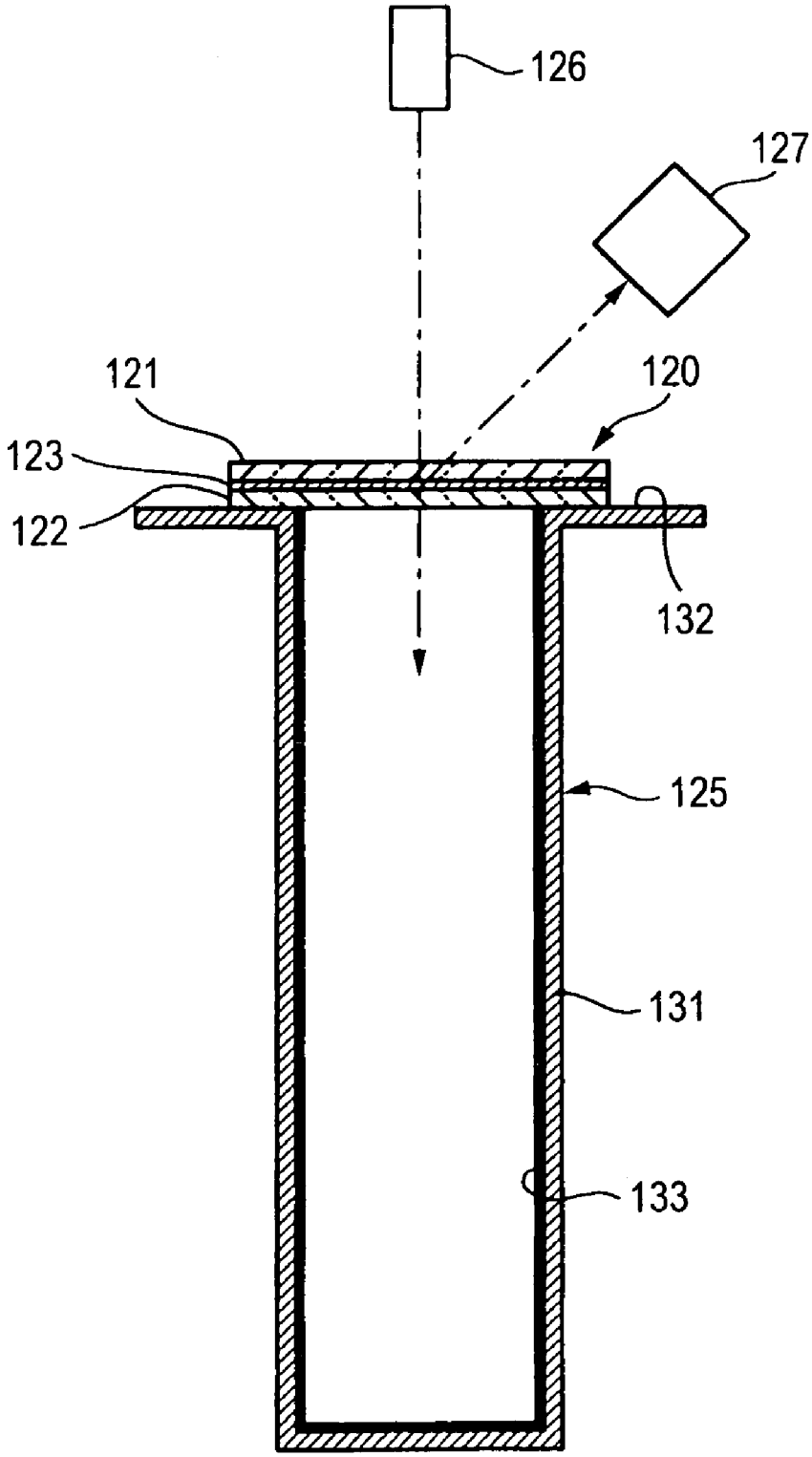
FIG. 5 is a diagram illustrating an example of the apparatus for measuring luminous reflectance as an indication of the melt-miscibility of the color toner-receiving layer of the image support to be used in an embodiment of implementation of the invention.

In FIG. 5, in order to remove scattering components from the surface and back surface of a resin film (film made of polyester-based resin) 123 to be measured, the resin film 123 is interposed between transparent cover glass sheets 121, 122 for microscopic observation. The gap between the cover glass sheets 121, 122 and the resin film 123 is filled with a refractive index matching solution (tetradecane) which is not shown. The sample 120 (cover glass sheets 121, 122+resin film 123) is placed on a light trap 125. The sample 120 is irradiated with light from a light source 126. The resulting reflection is measured by a colorimeter 127 (e.g., X-Rite 968) that satisfies geometrical colorimetric conditions of 0/45 degree. As the light trap 125 there may be selected one which comprises a table 132 provided at the opening side of a cylinder 131 open at one end thereof, which cylinder 131 being painted black on the inner wall thereof to act as a light-absorbing portion 133 so that light transmitted by the sample 120 is trapped.

The value Y on CIE XYZ calorimetric system thus measured corresponds to luminous reflectance Y. In the case where the resin film 123 to be measured is transparent and the cover glass sheets 121, 122, too, are transparent, Y is almost 0. In other words, the value of Y corresponds to the intensity of scattering components in the resin film 123. When the crystalline polyester resin and the amorphous polyester resin are insufficiently melt-mixed with each other, the scattering intensity of the resin film 123 made of polyester-based resin is great and indicates a great value of Y. On the other hand, when the two resins are highly mixed with each other, the resin film 123 exhibits less scattering and a reduced value of Y. Accordingly, Y is an indication of melt-miscibility.

The thickness of the resin film 123 to be measured is preferably 20 μm. In the case where the scattering intensity is 2% or less, the magnitude of Y is substantially proportional to the thickness of the film. Accordingly, when the thickness of the resin film 123 is not accurately 20 μm, Y may be calculated in terms of thickness.

The method of preparing the resin film 123 is not specifically limited so far as the purpose of forming a homogenous and uniform film cannot be impaired. However, in the case where a solution of resin in a solvent is spread to prepare a resin film 123, the resin mixed in the solvent can be separated from the solvent, occasionally making it impossible to form a homogeneous film. Therefore, a homogeneous film can be obtained by a method which comprises melting a resin over a smooth tabular substrate having a good releasability placed on a hot plate or the like, spreading the molten resin over the tabular substrate using a bar coater or the like, and then peeling the film off the tabular substrate. When the temperature of the hot plate exceeds the melt-mixing temperature, the mixed state changes. Therefore, the temperature of the hot plate needs to be predetermined to be about 20° C. lower than the mixing temperature.

Further, a sample obtained by superposing a film prepared on the tabular substrate (resin film 123) on a transparent film such as PET film, heating the laminate under pressure, and then peeling the tabular substrate off the film so that the film is transferred to the transparent film may be used for the measurement of Y. The reflectance $Y_0$ of the transferring film itself can be subtracted from the reflectance $Y_t$ of this sample to calculate Y of the resin film 123 to be measured.

The crystalline polyester resin and amorphous polyester resin constituting the color toner-receiving layer 14 will be further described hereinafter.

[Crystalline Polyester Resin]

The crystalline polyester resin has a melting point of from 80° C. to 130° C., preferably from 80° C. to 100° C., more preferably from 85° C. to 95° C. The weight-average molecular weight of the crystalline polyester resin is from 15,000 to 50,000, more preferably from 17,000 to 40,000 from the standpoint of low temperature fixability and mechanical strength. In the present embodiment, for the measurement of the melting point of the polyester-based resin, a differential scanning calorimeter (DSC) is used. The maximum value of endothermic peak developed when measurement is conducted at a heat rising rate of 10° C. from room temperature to 150° C. is defined as melting point.

Further, in the present embodiment, the term "crystalline" as in crystalline polyester resin is meant to indicate that the resin has a definite endothermic peak rather than stepwise endothermic change on DSC. A polymer having other components copolymerized with crystalline polyester main chain, too, is called crystalline polyester resin if the other components are incorporated therein in a small amount to give a definite endothermic peak on DSC.

In order to enhance the flexibility of the resin, the alcohol derivatives constituting the crystalline polyester resin are preferably $C_2$-$C_{14}$ straight-chain aliphatic groups.

The alcohol from which the alcohol components are derived is preferably an aliphatic diol.

Specific examples of the aliphatic diol include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,20-eicosanediol. However, the invention is not limited thereto. From the standpoint of fixability and heat resistance, preferred among these aliphatic diols are $C_6$-$C_{12}$ straight-chain aliphatic diols. More desirable among these aliphatic diols is nonanediol, which has 9 carbon atoms.

From the standpoint of melt-miscibility and low temperature fixability, the aforementioned $C_6$-$C_{12}$ straight-chain aliphatic diols account for all the alcohol derivatives in a proportion of from 85 to 98 mol %.

Examples of the acid from which the aforementioned acid constituents are derived include various dicarboxylic acids such as aromatic acid and aliphatic acid. From the standpoint of melt-miscibility, mechanical strength and heat resistance, aromatic dicarboxylic acids are preferred.

Examples of the aromatic dicarboxylic acid employable herein include terephthalic acid, dimethyl terephthalate, isophthalic acid, dimethyl isophthalate, 2,6-napthalenedicarboxylic acid, and 4,4'-biphenyl dicarboxylic acid. Preferred among these aromatic dicarboxylic acids are terephthalic acid, dimethyl terephthalate, isophthalic acid, dimethyl isophthalate and 2,6-napthalenedicarboxylic acid from the standpoint of low temperature fixability and mechanical strength. From the standpoint of mechanical strength and melt-miscibility, the aromatic components account for all the acid derivatives in a proportion of 90 mol % or more.

Examples of the aliphatic dicarboxylic acid include oxalic acid, malonic acid, succinic acid, glutaric acid, adipic acid, pimeric acid, suberic acid, azeric acid, sebasic acid, 1,9-nananedicarboxylic acid, 1,10-decanedicarboxylic acid, 1,11-undecane dicarboxylic acid, 1,12-dodecanedicarboxylic acid, 1,13-tridecanedicarboxylic acid, 1,14-tetradecane dicarboxylic acid, 1,16-hexadecanedicarboxylic acid, 1,18-octadecanedicarboxylic acid, and lower alkylesters or acid anhydrides thereof. However, the invention is not limited thereto.

In order to enhance the melt-miscibility, a third component is preferably copolymerized in an amount of from 2 to 12.5 mol %. When the proportion of the third component decreases, the melt-miscibility decreases, making it necessary that the mixing temperature be raised or the mixing time be prolonged. Thus, the productivity can be deteriorated and the heat resistance can be deteriorated. On the contrary, when the proportion of the third component exceeds the above defined range, the crystallinity is deteriorated to deteriorate heat resistance while the melt-miscibility is enhanced. When the heat resistance is deteriorated, the product is subject to defects such as blocking and offset when stored clamped between pages in album or when the image support 11 is allowed to stand in a high temperature warehouse or car.

From the standpoint of enhancement of melt-miscibility, as the third component there is preferably used a diol component such as bisphenol A, bisphenol A-ethylene oxide adduct, bisphenol A-propylene oxide adduct, hydrogenated bisphenol A, bisphenol S, bisphenol S-ethylene oxide adduct and bisphenol S-propylene oxide adduct. Further, from the standpoint of heat resistance, the third component derived from alcohol preferably accounts for all the alcohol derivatives in a proportion of from 2 to 15 mol %, more preferably from 3 to 8 mol %.

Moreover, as the third component there may be added an acid derivative from the standpoint of melt-miscibility. When two or more acid derivatives are added, the resulting crystalline polyester resin exhibits a deteriorated crystallinity and thus can be more fairly mixed with the other resin. In order to prevent the deterioration of heat resistance due to the deterioration of crystallinity, the proportion of the third component in all the acid derivatives is preferably 10% or less.

The method of producing the crystalline polyester resin is not specifically limited. The crystalline polyester resin can be produced by an ordinary polyester polymerization method involving the reaction of acid component with alcohol component. In some detail, the crystalline polyester resin can be synthesized by subjecting a dibasic acid and a divalent alcohol to esterification reaction or ester exchange reaction to prepare an oligomer which is then subjected to polycondensation reaction in vacuo. Alternatively, the crystalline polyester resin can be obtained by the depolymerization of polyester as disclosed in JP-B-53-37920. At least a dicarboxylic acid alkylester such as dimethyl terephthalate may be used as dibasic acid on one side in ester exchange reaction which is followed by polycondensation reaction. Alternatively, a dicarboxylic acid may be directly subjected to esterification which is followed by polycondensation.

For example, a dibasic acid and a divalent alcohol are reacted at a temperature of from 180° C. to 200° C. and atmospheric pressure for 2 to 5 hours until the distillation of water or alcohol is terminated to complete ester exchange reaction. Subsequently, the reaction product is heated to a temperature of from 200° C. to 230° C. for 1 to 3 hours while the pressure in the reaction system is being reduced to 1 Torr or less to obtain a crystalline polyester resin.

[Amorphous Polyester Resin]

The amorphous polyester resin has a glass transition point of from 50° C. to 80° C., preferably from 55° C. to 65° C. The amorphous polyester resin has a weight-average molecular weight of from 8,000 to 30,000, preferably from 8,000 to 16,000 from the standpoint of low temperature fixability and mechanical strength. The amorphous polyester resin may have a third component copolymerized therewith from the standpoint of low temperature fixability and miscibility.

The amorphous polyester resin preferably has the same alcohol derivatives or acid derivatives as the crystalline polyester resin does from the standpoint of enhancement of melt-miscibility. In particular, in the case where the main component of the alcohol derivatives constituting the crystalline polyester resin is a straight-chain aliphatic component and the main component of the acid derivatives constituting the crystalline polyester resin is an aromatic component, when the same straight-chain alcohol derivatives as the crystalline polyester resin does account for all the diols in a proportion of from 10 to 30 mol % and the same acid derivatives as the crystalline polyester resin does accounts for all the acid derivatives in a proportion of 90 mol % or more, the desired low temperature fixability can be satisfied and the melt-miscibility can be enhanced, allowing melt-mixing at low temperatures and hence making it possible to obtain a mixture having a good heat resistance.

Further, in the case where as the third component of the crystalline polyester resin there is incorporated an aromatic component which is an alcohol derivative, it is particularly preferred from the standpoint of melt-miscibility, heat resistance and low temperature fixability that the same aromatic component be incorporated as a main component of the alcohol derivatives constituting the amorphous polyester resin in a proportion of from 70 to 90 mol % based on all the alcohol derivatives.

The method of producing the amorphous polyester resin is not specifically limited as in the method of producing the crystalline polyester resin. Any ordinary polyester polymerization method as mentioned above may be used.

Further, as the acid derivatives there may be used similarly used the various dicarboxylic acids exemplified with reference to the crystalline polyester resin. As the alcohol derivatives there may be used various diols. In addition to the aliphatic diols exemplified with reference to the crystalline polyester resin, bisphenol A, bisphenol A-ethylene oxide adduct, bisphenol A-propylene oxide adduct, hydrogenated bisphenol A, bisphenol S, bisphenol S-ethylene oxide adduct, bisphenol S-propylene oxide adduct, etc. may be used. The amorphous polyester resin may contain a plurality of acid derivatives and alcohol derivatives.

The color toner-receiving layer 14 preferably has a wax, an inorganic particulate material, an organic particulate material, etc. incorporated therein besides the thermoplastic resin. However, the proportion of the thermoplastic resin is preferably 80% by weight or more. This is because when the proportion of the thermoplastic resin falls below 80% by weight, it is likely that problems such as excessively raised viscosity and deteriorated heat resistance can arise.

Further, it is particularly preferred that the color toner-receiving layer 14 comprise an inorganic particulate material incorporated therein in an amount of from 3 to 15% by weight. The inorganic particulate material to be used herein is not specifically limited so far as whiteness can be impaired and can be properly selected from known particulate materials depending on the purpose. Examples of the particulate material include silica, titanium dioxide, barium sulfate, and calcium carbonate. Taking into account the dispersibility in the resin, these inorganic particulate materials may be hydrophobicized with a silane coupling agent, titanium coupling agent or the like before use.

The average particle diameter of the inorganic particulate material is particularly preferably from 0.005 μm to 1 μm. When the average particle diameter of the inorganic particulate material falls below 0.005 μm, the inorganic particulate material itself undergoes aggregation when mixed with a resin, occasionally making it impossible to exert a desired effect. On the contrary, when the average particle diameter of the inorganic particulate material exceeds 1 μm, it is difficult to obtain an image having a higher gloss.

The resin thus having an inorganic particulate material incorporated therein can be solidified more rapidly after fixing. When the amount of the inorganic particulate material to be incorporated falls below 3% by weight, little or no effect of expediting solidification can be exerted. When the amount of the inorganic particulate material to be incorporated exceeds 15% by weight, the resulting mixture exhibits a reduced viscosity at the fixing temperature, making it impossible to form a high gloss image surface.

As the inorganic particulate material there is preferably used one mainly composed of titanium dioxide or silica having a particle diameter of from 8 to 200 nm. Such an inorganic particulate material never impairs whiteness and can expedite solidification even when incorporated in a small amount.

Not only an inorganic particulate material but also an organic particulate material can expedite solidification of the resin after fixing. The organic particulate material to be used herein is not specifically limited so far as whiteness cannot be impaired and can be properly selected from known particulate materials depending on the purpose. Examples of the organic particulate material employable herein include polyester-based resins, polystyrene-based resins, talc, kaolin clay, acrylic resins, vinyl-based resins, polycarbonate-based resins, polyamide-based resins, polyimide-based resins, epoxy-based resins, polyurea-based resins, and fluororesins.

The average particle diameter of the organic particulate material is particularly preferably from 0.005 μm to 1 μm. When the average particle diameter of the organic particulate material falls below 0.005 μm, the organic particulate material itself undergoes aggregation when mixed with a resin, occasionally making it impossible to exert a desired effect. On the contrary, when the average particle diameter of the organic particulate material exceeds 1 μm, it is difficult to obtain an image having a higher gloss.

The composition of the wax to be used herein is not specifically limited so far as the effect of the present embodiment cannot be impaired and can be properly selected from known materials used as wax depending on the purpose. Examples of the wax material employable herein include polyethylene-based resins, and carnauba natural wax. A wax having a melting point of from 80° C. to 110° C. is preferably incorporated in a proportion of from 0.2 to less than 8% by weight.

The method of mixing the resin, inorganic particulate material and other additives constituting the color toner-receiving layer 14 is not specifically limited so far as the purpose of uniformly dispersing the inorganic particulate material and other additives in the resin can be accomplished. Any known mixing method may be used.

For example, a method which comprises mixing a white pigment and other additives in a molten resin using an extrusion type kneader or a method which comprises subjecting a resin, an inorganic particulate material, other additives and a surface active agent to high speed agitation in water to form an emulsion may be employed. It is particularly preferred from the standpoint of uniform dispersion of inorganic particulate material and other additives in the resin that these components be melt-mixed.

The method of spreading the color toner-receiving layer 14 doesn't need to be specifically limited so far as the purpose of forming a uniform and smooth color toner-receiving layer 14 can be accomplished. For example, an apparatus based on a melt extrusion method also capable of dispersing the inorganic particulate material and other additives uniformly in the resin may be proposed.

The melt extrusion method may involve a lamination method which comprises allowing a molten resin film extruded from a heated extruder through a wide slit die (so-called T-die) to come in contact with the light-scattering layer 13 on the raw paper 12 to which it is then continuously pressure-bonded over rollers or a method which comprises extruding the molten resin film onto a cooling roll on which it is then wound up to form a film which is then spread over the light-scattering layer 13 using a laminating unit. In accordance with this melt-extrusion method, a uniform film made of the aforementioned resin, inorganic particulate material and other additives can be easily formed on the light-scattering layer 13 of the raw paper 12.

Alternatively, the crystalline polyester resin and the amorphous polyester resin may be previously melt-mixed under predetermined conditions. The resin mixture and other additives may then be mixed, and then melt-extruded to form a film. In this case, however, it is necessary that the melt-extrusion conditions be determined such that the melt-extrusion temperature or time be not too high or long, preventing further progress of mixing that can impair the desired properties. In some detail, it is necessary that extrusion be effected at a temperature lower than the melt-mixing temperature in a short period of time.

The use of the melt-extrusion method makes it also possible to melt-mix the crystalline polyester resin and the amorphous polyester resin under predetermined conditions. By charging the resin and additives in an apparatus which has been predetermined in melt-mixing temperature and extrusion time to provide desired properties and then melt-extruding the mixture through the apparatus, a homogeneous film that can satisfy desired properties can be formed.

The extruder to be used in the formation of the transferred layer (formed by the light-scattering layer 13 and the color toner-receiving layer 14 formed on the image support 11 in the present embodiment) may be either monoaxial or biaxial but essentially should be capable of uniformly mixing the white pigment and other additives in the resin. Alternatively, an emulsion having the resin, inorganic particulate material and other additives dispersed in water may be spread using any known method such as roll coating method, bar coating method and spin coating method.

The image support 11 to be used in the present embodiment may comprise a raw paper 12, a light-scattering layer 13 and a color toner-receiving layer 14 but may further comprise other layers.

Figure 6A:
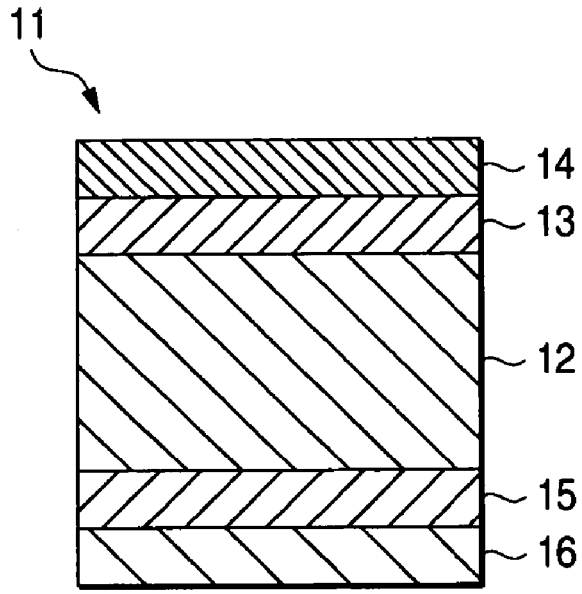
FIGS. 6A and 6B each are a diagram illustrating the sectional structure of modifications of the image support to be used in an embodiment of implementation of the invention.

For example, as shown in FIG. 6A, the image support 11 may a reinforcement layer 15 made of a polyethylene resin layer formed on the back side of the raw paper 12 and an antistatic layer 16 provided on the reinforcement layer 15.

In accordance with the present embodiment, the aforementioned image support 11 is advantageous in that the aforementioned image support 11 has a high whiteness and a smooth and gloss surface, causes no offset even when an image is formed on the back side thereof, can provide an image structure having a sharp color and a smooth granularity, can be more fairly conveyed and is little subject to staining with dust.

The antistatic layer 16 is intended to keep the surface resistivity of the back side of the image support 11 within a range of from $10^6$ to $10^{10}\Omega/\square$ and doesn't need to be specifically limited so far as the purpose can be accomplished. Examples of the antistatic layer employable herein include coat layer of colloidal silica, colloidal alumina or the like, coat layer of a mixture of a particulate material such as alumina and silica with a small amount of a thermoplastic resin, and coat layer of a resin solution having an ionic surface active agent dispersed therein.

Figure 6B:
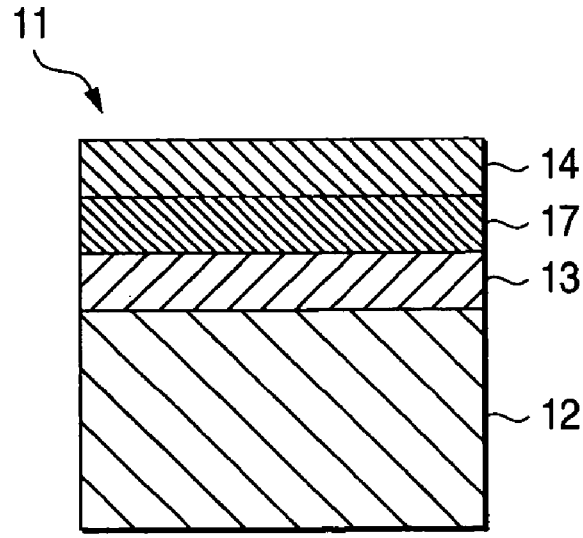

In another preferred embodiment, the image support 11 may comprise a gelatin layer 17 provided interposed between the light-scattering layer 13 and the color toner-receiving layer 14 as shown in FIG. 6B.

The present embodiment is advantageous in that the adhesion between the color toner-receiving layer 14 and the light-scattering layer 13 can be enhanced. In particular, when the material constituting the color toner-receiving layer 14 is spread in the form of aqueous emulsion solution, the gelatin layer 17 acts effectively to form a uniform color toner-receiving layer 14.

In the present embodiment, as the color toner to be used in the color toner image there may be used an insulating particulate material having at least a thermoplastic resin and a colorant incorporated therein. Examples of the color toner employable herein include yellow toner, magenta toner, cyan toner, and black toner.

The thermoplastic resin to be used herein may be properly selected depending on the purpose. Examples of the thermoplastic resin employable herein include known resins commonly used for toner such as polyester-based resin, polystyrene-based resin, acrylic resin, other vinyl-based resins, polycarbonate-based resin, polyamide-based resin, epoxy resin and polyurea-based resin, and copolymers thereof. Preferred among these thermoplastic resins are polyester-based resins and resins made of styrene-acryl copolymer because they can satisfy toner properties such as low temperature fixability, fixing strength and preservability at the same time. The thermoplastic resin preferably exhibits a weight-average molecular weight of from 5,000 to 40,000 and a glass transition point of from not lower than 55° C. to lower than 75° C.

As the colorant there may be used a coloring material commonly used in the formation of color image.

Any of dye-based and pigment-based colorants may be used, but pigment-based colorants are preferred from the standpoint of light-resistance. Examples of colorants for Y (yellow) include benzidine yellow, quinoline yellow, and Hansa yellow. Examples of colorants for M (magenta) include Rhodamine B, rose Bengal, and pigment red. Examples of colorants for C (cyan) include phthalocyanine blue, aniline blue, and pigment blue. Examples of colorants for K (black) include carbon black, aniline black, and blend of color pigments.

In order to expand the range of color reproduction, it is important to suppress irregular reflection on the interface of pigment in colorant with thermoplastic resin. A combination of the colorant of the invention with a colorant having small diameter pigment particles finely dispersed therein as disclosed in JP-A-4-242752 is effective.

Referring to the amount of the coloring material in the toner, different coloring materials exhibit different spectral absorption characteristics and color development properties and thus are used in different optimum amounts. Therefore, the optimum amount of the coloring material is preferably determined properly within a range of from 3 to 10% by weight, which is an ordinary range, taking into account the range of color reproduction.

The color toner preferably comprises a wax incorporated therein. The composition of wax is not specifically limited so far as the effect of the present embodiment cannot be impaired and can be properly selected from known materials used as wax depending on the purpose. Examples of the wax material include polyethylene-based resins, and carnauba natural wax. A wax having a melting point of from 80° C. to 110° C. is preferably incorporated in a proportion of from 0.2 to 8% by weight.

The particle diameter of the color toner doesn't need to be specifically limited but is preferably from 4 μm to 8 μm from the standpoint of assurance of image having a good granularity and gradation.

As the method of preparing the particular color toner there may be used any method known as such. For example, the particulate color toner may be produced by a grinding classification process toner preparation method which comprises melt-mixing the aforementioned toner materials (colorant, thermoplastic resin, etc.), grinding the mixture using a mechanical grinder or the like, and then classifying the particles using an air classifier or the like. However, in the present embodiment, the color toner is prepared by EA process (Emulsion Aggregation process) which comprises aggregating emulsion particles having a submicron size prepared by emulsion polymerization, and the heating the aggregate so that the particles are coalesced to prepare a particulate toner. The toner prepared by EA process has a sharp particle size distribution and thus is suitable for the formation of a uniform image. At the same time, the toner prepared by EA process can be easily controlled in its shape and thus is suitable for the enhancement of transferability. Accordingly, the toner of the invention is effective for the formation of an image having a high granularity.

In order to obtain an image having a good granularity and tone reproducibility, it is necessary to control the toner fluidity and chargeability. From this standpoint of view, the surface of the color toner preferably has an inorganic particulate material and/or an organic particulate material externally added or attached thereto.

The inorganic particulate material to be used herein is not specifically limited so far as the effect of the present embodiment cannot be impaired and can be properly selected from known particulate materials used as external additives depending on the purpose. Examples of the inorganic particulate material employable herein include silica, titanium dioxide, tin oxide, and molybdenum oxide. Taking into account the stability such as chargeability, these inorganic particulate materials may be hydrophobicized with a silane coupling agent, titanium coupling agent or the like before use.

The organic particulate material to be used herein is not specifically limited so far as the effect of the present embodiment cannot be impaired and can be properly selected from known particulate materials used as external additives depending on the purpose. Examples of the organic particulate material employable herein include polyester-based resins, polystyrene-based resins, vinyl-based resins, polycarbonate-based resins, polyamide-based resins, polyimide-based resins, epoxy-based resins, polyurea-based resins, and fluororesins.

The average particle diameter of the inorganic particulate material and organic particulate material each are particularly preferably from 0.005 μm to 1 μm. When the average particle diameter of these particulate materials each fall below 0.005 μm, these particulate materials undergo aggregation when attached to the surface of the toner, occasionally making it impossible to exert a desired effect. On the contrary, when the average particle diameter of the particulate materials each exceed 1 μm, it is difficult to obtain an image having a higher gloss.

The thermoplastic resin of the color toner preferably exhibits a viscosity of $10^3$ Pa·s or more at the ultimate temperature of the fixing unit (corresponding to the upper limit of fixing temperature).

When the viscosity of the thermoplastic resin falls below $10^3$ Pa·s, the expansion of color toner image (dot gain) at the fixing step becomes remarkable, making it likely that the color toner image in the middle density area is disturbed to impair granularity, thicken the line or collapse letters.

The color toner is combined with a properly selected carrier which is known itself to form a developer which is then used. Alternatively, the color toner may be triboelectrically charged with a development sleeve and a charging member to form a chargeable toner which is then developed according to electrostatic latent image.

The transparent toner to be used in the formation of a transparent toner image in the present embodiment is an insulating particulate material having at least a thermoplastic resin incorporated therein.

The thermoplastic resin to be used herein may be properly selected depending on the purpose. Examples of the thermoplastic resin employable herein include known resins commonly used for toner such as polyester-based resin, polystyrene-based resin, acrylic resin, other vinyl-based resins, polycarbonate-based resin, polyamide-based resin, polyimide-based resins, epoxy resin and polyurea-based resin, and copolymers thereof.

Preferred among these thermoplastic resins are polyester-based resins and resins made of styrene-acryl copolymer because they can satisfy toner properties such as low temperature fixability, fixing strength and preservability at the same time. The thermoplastic resin preferably exhibits a weight-average molecular weight of from 5,000 to 40,000 and a glass transition point of from not lower than 50° C. to lower than 70° C.

The transparent toner preferably has a wax incorporated therein.

The composition of the wax to be used herein is not specifically limited so far as the effect of the present embodiment cannot be impaired and can be properly selected from known materials used as wax depending on the purpose. Examples of the wax material employable herein include polyethylene-based resins, and carnauba natural wax. A wax having a melting point of from 80° C. to 110° C. is preferably incorporated in a proportion of from not smaller than 0.2 to less than 8% by weight.

The transparent toner preferably has an average particle diameter of from not smaller than 3 μm to not greater than 7 μm from the standpoint of assurance of image having a good granularity and gradation.

Further, as the method of preparing the particulate transparent toner there may be used any method known as such. For example, the particulate transparent toner may be produced by a grinding classification process toner preparation method which comprises melt-mixing the aforementioned toner materials (comprising at least a thermoplastic resin), grinding the mixture using a mechanical grinder or the like, and then classifying the particles using an air classifier or the like. However, in the present embodiment, the particulate transparent toner is prepared by EA process (Emulsion Aggregation process) which comprises aggregating emulsion particles having a submicron size prepared by emulsion polymerization, and the heating the aggregate so that the particles are coalesced to prepare a particulate toner.

In order to obtain a transparent toner image having a high uniformity, it is necessary to control the fluidity and chargeability of the transparent toner. From this standpoint of view, the surface of the transparent toner preferably has an inorganic particulate material and/or an organic particulate material externally added or attached thereto.

The inorganic particulate material to be used herein is not specifically limited so far as the effect of the present embodiment cannot be impaired and can be properly selected from known particulate materials used as external additives depending on the purpose. Examples of the inorganic particulate material employable herein include silica, titanium dioxide, tin oxide, and molybdenum oxide. Taking into account the stability such as chargeability, these inorganic particulate materials may be hydrophobicized with a silane coupling agent, titanium coupling agent or the like before use.

The organic particulate material to be used herein is not specifically limited so far as the effect of the present embodiment cannot be impaired and can be properly selected from known particulate materials used as external additives depending on the purpose. Examples of the organic particulate material employable herein include polyester-based resins, polystyrene-based resins, vinyl-based resins, polycarbonate-based resins, polyamide-based resins, polyimide-based resins, epoxy-based resins, polyurea-based resins, and fluororesins.

The average particle diameter of the inorganic particulate material and organic particulate material each are particularly preferably from 0.005 μm to 1 μm. When the average particle diameter of these particulate materials each fall below 0.005 μm, these particulate materials undergo aggregation when attached to the surface of the toner, occasionally making it impossible to exert a desired effect. On the contrary, when the average particle diameter of the particulate materials each exceed 1 μm, it is difficult to obtain an image having a higher gloss.

The transparent toner is combined with a properly selected carrier which is known itself to form a developer which is then used. Alternatively, the color toner may be triboelectrically charged with a development sleeve and a charging member to form a chargeable toner which is then developed according to electrostatic latent image.

The thickness of the transparent toner image is preferably from 2 μm to 10 μm on the non-image area. When the thickness of the transparent toner image on the non-image area is too small, the toner-receiving layer is partly exposed, making it impossible to form a smooth surface. Thus, there occurs a difference in the thickness of color toner between on the non-image area and on the image area (step on image). Further, there remains some unevenness on the surface of image due to halftone structure. Accordingly, the gloss of the halftone area cannot be raised. On the contrary, when the thickness of the transparent toner image on the non-image area is too great, the transferred color toner image is disturbed. It is essential from the standpoint of assurance of smoothness that any of color toner image and transparent toner image be formed on the toner-receiving layer. Therefore, a transparent toner image is not necessarily needed for areas where a color toner is formed without any gap.

Accordingly, from the standpoint of reduction of toner consumption and step on image, it is preferred that the thickness of the transparent toner image be varied depending on the percent coverage of color toner image (proportion of color toner image accounting for all the image forming region). This may be accomplished by modulating the input signal of transparent toner image 22 according to the percent area occupation of image data to switch the percent area exposure to laser beam.

As the imaging unit 30 (see FIG. 3) in the present embodiment there is used a known electrophotographic process toner image-forming apparatus.

For example, an embodiment comprising a photoreceptor, a charging unit for charging the photoreceptor, an exposure unit for exposing the photoreceptor, an image signal forming unit for controlling an image signal for forming a color image, a developing unit for rendering the latent image on the photoreceptor visible and a transferring unit for transferring the toner image on the photoreceptor onto the image support may be proposed.

The photoreceptor to be used herein is not specifically limited. The photoreceptor may be known and may have a single layer structure or a multi-layer structure allowing function separation. The photoreceptor may be made of an inorganic material such as selenium and amorphous silicon or an organic material such as OPC.

As the charging unit there may be used a unit known as such, e.g., contact charging process unit using an electrically-conductive or semiconductive roll, brush, film or rubber blade, non-contact charging process unit using corotoron charging or scorotron charging involving corona discharge.

As the exposing unit there may be used any known exposing unit such as laser scanner (ROS: Raster Output Scanner) comprising a semiconductor laser, a scanner and an optical system and LED head. Taking into account a preferred embodiment capable of forming an exposed image having a high resolution, ROS or LED head is preferably used.

As the image signal-forming unit there may be any known unit which can generate a signal such that a toner image is developed on a desired site on the image support.

As the developing unit there may be any known developing unit, regardless of whichever the toner is one-component or two-component, so far as the purpose of forming a uniform toner image having a high resolution on the photoreceptor can be accomplished. From the standpoint of assurance of good granularity and smooth tone reproducibility, a two-component development process developing unit is preferably used.

Further, as the transferring unit (primary transferring unit if it is of intermediate transferring type) there may be used any known unit such as unit for transferring a toner image composed of charged toner particles by an electric field formed between the photoreceptor and the image support or the intermediate transferring material using an electrically-conductive or semiconductive roll, brush, film or rubber blade to which a voltage is applied and unit for transferring a toner image composed of charged toner particles by corona-charging the back side of the image support or intermediate transferring material using a corotoron or scorotoron charger utilizing corona discharge.

As the intermediate transferring material there may be used an insulating or semiconductive belt material or a drum-shaped material having an insulating or semiconductive surface. A semiconductive belt material is preferably used because it can keep the transferring properties stable during continuous image formation, making it possible to reduce the size of the unit. As such a belt material there is known one made of a resin material having an electrically-conductive filler such as electrically-conductive carbon dispersed therein. As such a resin there is preferably used, e.g., polyimide resin.

As the secondary transferring unit using an intermediate material there may be used any known unit such as unit for transferring a toner image composed of charged toner particles by an electric field formed between the intermediate transferring material and the image support or the intermediate transferring material using an electrically-conductive or semiconductive roll, brush, film or rubber blade to which a voltage is applied and unit for transferring a toner image composed of charged toner particles by corona-charging the back side of the intermediate transferring material using a corotoron or scorotoron charger utilizing corona discharge.

As the fixing unit there may be properly selected any fixing unit. However, the fixing unit preferably has a belt-shaped fixing member (fixing belt) and comprises a heat pressing unit for heat-pressing an image on the image support using the belt-shaped fixing member and a cooling/peeling unit for cooling/peeling the image thus heat-pressed off the belt-shaped fixing member.

As the belt-shaped fixing member there may be a resin film such as polyimide or a metal film such as stainless steel. The belt-shaped fixing member preferably has a release layer laminated on a heat-resistant base substrate because it is required to have a high heat resistance and a good releasability. In this case, as the base substrate there is preferably used a polyimide resin or stainless steel. As the release layer there is preferably used a silicone rubber, fluororubber, fluororesin or the like. In order to maintain a stable releasability or eliminate attachment of stain such as dust, it is preferred that the resistivity of the base substrate be adjusted, e.g., by dispersing an electrically-conductive additive such as electrically-conductive particulate carbon and electrically-conductive polymer therein.

The base substrate may be sheet-shaped but is preferably in the form of endless belt. From the standpoint of smoothness, the surface gloss is preferably 60 or more as measured by a 75 degree glossmeter. When the gloss is low, the surface of image fixed is affected, causing the shortage of smoothness of the surface of image itself.

As the aforementioned heat pressing unit there may be used any unit known as such.

For example, a heat pressing unit which drives a belt-shaped fixing member and an image support having an image formed thereon while being interposed between a pair of rollers which are driven at a constant rate may be used.

One or both of the rolls have a heat source provided thereinside. The surface of the rolls are heated to a temperature at which the transparent toner is melted. The two rolls are brought into pressure contact with each other. Preferably, one or both of the rolls have a silicone rubber or fluororubber layer provided on the surface thereof. It is preferred that the length of the region at which heat pressing is effected (nip width) be from 1 mm to 8 mm.

The surface temperature of the heating roll and pressure roll at the fixing step is preferably adjusted such that the viscosity of the color toner-receiving layer at the rear end of the region at which the two rolls are brought into pressure contact with each other (outlet side of fixing nip region) is $10^3$ Pa·s or less when the thermoplastic resin made of a mixture of a crystalline resin and an amorphous resin is used for the color toner-receiving layer, or $10^4$ Pa·s or less when the thermoplastic resin that comprises an amorphous resin as a main component and has a glass transition temperature of 50° C. or more is used for the color toner-receiving layer.

As the cooling/peeling unit there may be used one which cools the image support press-heated on the belt-shaped fixing member and then peels the image support by a peeling member.

As the cooling means there may be used spontaneous cooling. From the standpoint of size of the unit, a cooling member such as heat sink and heat pipe is preferably used to raise the cooling rate. As the peeling member there is preferably used an embodiment involving the insertion of a peeling nail into the gap between the belt-shaped fixing member and the image support or an embodiment involving the peeling with a roll having a small radius of curvature (peeling roll) provided at the peeling site.

As the conveying unit for conveying the image support onto the fixing unit there may be used any conveying unit which is known itself.

Since the conveying rate is preferably constant, a unit which drives the image support while being interposed between a pair of rubber rolls which are rotated at a constant rate or a unit which drives the image support at a constant rate over a belt wound on a pair of rolls made of rubber or the like one of which is driven at a constant rate by a motor or the like.

In particular, in the case where an unfixed toner image is formed, the later unit is preferably used from the standpoint of prevention of disturbance of toner image.

The image-forming apparatus shown in FIG. 3 will be further described. In the present embodiment, the colored toner imaging unit and the transparent toner imaging unit are composed of substantially the same imaging unit 30.

In FIG. 3, as the imaging unit 30 there is used one comprising a photoreceptor drum 31, a charging unit 32 for charging the photoreceptor drum 31, an exposing unit 33 for forming an electrostatic latent image on the photoreceptor drum 31, a rotary developing unit 34 having developing units 34*a* to 34*d* having yellow, magenta, cyan and black color toners received therein and a developing unit 34*e* having a transparent toner received therein, an intermediate transferring belt 35 for temporarily retaining the image on the photoreceptor drum 31 and a cleaning unit 36 for cleaning the residual toner away from the photoreceptor drum 31 provided around the photoreceptor drum 31, wherein the intermediate transferring belt 35 has a primary transferring unit (e.g., primary transferring roll) 37 provided at the site thereof opposed to the photoreceptor drum 31 and a secondary transferring unit (comprising a pair of secondary transferring roll 38*a* and backup roll 38*b* with the intermediate transferring belt 35 and the image support 11 interposed therebetween in this example) 38 provided at the site thereof over which the image support 11 passes.

The intermediate transferring belt 35 extends over a plurality of tension rolls 41 to 46. The intermediate transferring belt 35 is circulated with the tension roll 41 as driving roll and the tension roll 44 as tension roll, for example. Further, the intermediate transferring belt 35 has a belt cleaner 47 provided at the site thereof opposed to the tension roll 41 detachably from the intermediate transferring belt 35 for cleaning the residual toner, etc. away from the intermediate transferring belt 35. In the present embodiment, the tension roll 46 acts as backup roll 38*b*.

In the present embodiment, provided upstream the secondary transferring unit 38 for conveying the image support 11 are a conveyance guide 48 for guiding the conveyance of the image support 11 and a resist roll 49 for limiting the positioning of the image support 11. Provided upstream the resist roll 49 is a paper feed cassette as an image support supplying unit which is not shown. In this arrangement, the image support 11 is conveyed to the resist roll 49 by a conveying unit which is not shown.

The fixing unit 50 comprises a fixing belt (e.g., belt material having a silicone rubber spread over the surface thereof) 51 extending over a proper number (3 in the present embodiment) of tension rolls 52 to 54, a heating roll 52 which is a tension roll disposed at the inlet side of the fixing belt 51 capable of being heated, a peeling roll 53 which is a tension roll disposed at the outlet side of the fixing belt 51 capable of peeling the image support, a pressure roll (optionally having a heat source added thereto) 55 disposed to the heating roll 52 in pressure contact therewith with the fixing belt 51 interposed therebetween and a heat sink 56 which is a cooling member disposed inside the fixing belt 51 for cooling the fixing belt 51 in the course from the heating roll 52 to the peeling roll 53.

Provided between the fixing unit 50 and the image forming site of the imaging unit 30 is a conveying unit 60 composed of, e.g., conveying belt.

The operation of an image-forming apparatus according to the present embodiment will be described in connection with FIG. 3.

In order to obtain a color copy, for example, using an image-forming apparatus according to the present embodiment, image data on a required number of color toners and image data on a transparent toner are determined from data read out from the original to be copied.

Using the exposure unit 33, the photoreceptor 31 is then irradiated with light from required color images according to these image data by plural times per color to form a plurality of electrostatic latent images. These electrostatic latent images are sequentially developed with a transparent toner and four color toners, i.e., yellow, magenta, cyan and black toners using the transparent toner developer 34*e*, yellow developer 34*a*, magenta developer 34*b*, cyan developer 34*c* and black developer 34*d*, respectively.

The toner images thus developed were sequentially transferred from the photoreceptor drum 31 onto the intermediate transferring belt 35 by the primary transferring unit 37. The transparent toner image and the four color toner images which have been sequentially transferred onto the intermediate transferring belt 35 are then transferred onto the image support 11 at once by the secondary transferring unit 38.

Thereafter, the image support 11 onto which a toner image having a transparent toner image 22 formed on a color toner image 21 has been transferred is then conveyed to the fixing unit 50 via the conveying unit 60 as shown in FIG. 3.

The color toner image 21 has unfixed color toner particles kept laminated on the color toner-receiving layer 14 on the image support 11.

Referring next to the operation of the fixing unit 50, the heating roll 52 and the pressure roll 55 are previously heated to the melting temperature of the toner. A load of 100 kg is applied to the two rolls 52, 55. The two rolls 52, 55 are rotationally driven. The fixing belt 51 moves following the rolls 52, 55.

The fixing belt 51 comes in contact with the surface of the image support 11 onto which the color toner image 21 and the transparent toner image 22 have been transferred at the nip between the heating roll 52 and the pressure roll 55 so that the color toner image 21 and the transparent toner image 22 are heated and melted (heat pressing step).

Since the melt properties of the light-scattering layer 13 and color toner-receiving layer 14, the color toner image 21 and the transparent toner image 22 on the image support 11 are predetermined within desired ranges, the color toner image 21 can be fully embedded in the color toner-receiving layer 14 and the highly smooth surface shape of the fixing belt 51 can be transferred to the color toner-receiving layer 14 side which is the surface of the image support 11.

In this manner, the image support 11 and the fixing belt 51 are conveyed onto the peeling roll 53 while being kept bonded to each other with a molten toner layer (composed of color toner image 21 and transparent toner image 22) interposed therebetween. During this procedure, the fixing belt 51, the toner layer and the image support 11 are cooled by the heat sink 56 (cooling step).

Accordingly, when the image support 11 reaches the peeling roll 53, the curvature of the peeling roll 53 causes the toner layer and the image support 11 to be peeled off the fixing belt 51 altogether (peeling step).

In this manner, a smooth and high gloss color image is formed on the image support 11.

These properties are substantiated in the examples described later.

While the present embodiment has been described with reference to the case where the imaging unit 30 of the image-forming apparatus is of so-called plural cycle type, the invention is not limited thereto. A so-called tandem system involving the juxtaposition of imaging sites for toners used may be employed.

While the present embodiment has been described with reference to the case where the fixing unit 50 is disposed downstream the conveying unit 60 in the image-forming apparatus, the fixing unit 50 may be provided separately of the image-forming apparatus.

While the present embodiment has been described with reference to the case where the color toner image 21 and the transparent toner image 22 are sequentially laminated before fixing and then fixed altogether, the color toner image 21 may be first formed and fixed (temporarily, for example) and the transparent toner image 22 may then be formed and fixed so far as the smoothness of image can be assured.

Further, the image support 11 having the color toner image 21 and the transparent toner image 22 formed thereon may be subjected to multistage fixing (temporary fixing at first stage and full fixing at second stage, for example) to assure desired heat capacity during fixing.

EXAMPLE

Crystalline polyester resins A to E and amorphous polyester resins F to I of color toner-receiving layer to be used in the following Examples 1 to 16 and Comparative Examples 1 to 10 will be first described hereinafter.

[Preparation of Crystalline Polyester Resins]

Crystalline Polyester Resin A: TPA/ND/BPA=50/47.5/2.5 (Molar Ratio)

TPA stands for terephthalic acid, ND stands for nonanediol and BPA stands for bisphenol A-oxide adduct.

Into a three-necked flask which had been heated and dried were charged 194 parts by weight of dimethyl terephthalate, 152 parts by weight of 1,9-nonanediol, 15.8 parts by weight of bisphenol A-ethylene oxide adduct and 0.15 parts by weight of dibutyl tin oxide as a catalyst. The air in the vessel was replaced by nitrogen gas by a pressure reduction method to form an inert atmosphere in which the mixture was then mechanically stirred at 180° C. for 5 hours.

Thereafter, the mixture was gradually heated to 230° C. with stirring under reduced pressure for 2 hours. When the mixture became viscous, the product was then air-cooled to suspend the reaction. The resulting resin was then used as crystalline polyester resin A.

The crystalline polyester resin A thus obtained had a weight-average molecular weight (Mw) of 22,000 and a number-average molecular weight (Mn) of 10,900 as determined by gel permeation chromatography (GPC) (in polystyrene equivalence).

The crystalline polyester resin A was measured for melting point (Tm) by DSC. As a result, the crystalline polyester resin A showed a definite peak. The peak top was at 94° C.

Crystalline Polyester Resin B: TPA/ND/BPS=50/47.5/2.5

BPS stands for bisphenol S-ethylene oxide adduct.

Into a three-necked flask which had been heated and dried were charged 194 parts by weight of dimethyl terephthalate, 152 parts by weight of 1,9-nonanediol, 16.9 parts by weight of bisphenol S-ethylene oxide adduct and 0.15 parts by weight of dibutyl tin oxide as a catalyst. The air in the vessel was replaced by nitrogen gas by a pressure reduction method to form an inert atmosphere in which the mixture was then mechanically stirred at 180° C. for 5 hours.

Thereafter, the mixture was gradually heated to 230° C. with stirring under reduced pressure for 2 hours. When the mixture became viscous, the product was then air-cooled to suspend the reaction. The resulting resin was then used as crystalline polyester resin B.

The crystalline polyester resin B thus obtained had a weight-average molecular weight (Mw) of 23,000 and a number-average molecular weight (Mn) of 12,000 as determined by gel permeation chromatography (GPC) (in polystyrene equivalence).

The crystalline polyester resin B was measured for melting point (Tm) by DSC. As a result, the crystalline polyester resin B showed a definite peak. The peak top was at 92° C.

Crystalline Polyester Resin C: TPA/ND/BPS=50/45/5

Into a three-necked flask which had been heated and dried were charged 194 parts by weight of dimethyl terephthalate, 144 parts by weight of 1,9-nonanediol, 31.6 parts by weight of bisphenol A-ethylene oxide adduct and 0.15 parts by weight of dibutyl tin oxide as a catalyst. The air in the vessel was replaced by nitrogen gas by a pressure reduction method to form an inert atmosphere in which the mixture was then mechanically stirred at 180° C. for 5 hours.

Thereafter, the mixture was gradually heated to 230° C. with stirring under reduced pressure for 2 hours. When the mixture became viscous, the product was then air-cooled to suspend the reaction. The resulting resin was then used as crystalline polyester resin C.

The crystalline polyester resin C thus obtained had a weight-average molecular weight (Mw) of 22,000 and a number-average molecular weight (Mn) of 11,000 as determined by gel permeation chromatography (GPC) (in polystyrene equivalence).

The crystalline polyester resin C was measured for melting point (Tm) by DSC. As a result, the crystalline polyester resin C showed a definite peak. The peak top was at 90° C.

Crystalline Polyester Resin D: TPA/ND=50/50

Into a three-necked flask which had been heated and dried were charged 194 parts by weight of dimethyl terephthalate, 160 parts by weight of 1,9-nonanediol, and 0.15 parts by weight of dibutyl tin oxide as a catalyst. The air in the vessel was replaced by nitrogen gas by a pressure reduction method to form an inert atmosphere in which the mixture was then mechanically stirred at 180° C. for 5 hours.

Thereafter, the mixture was gradually heated to 230° C. with stirring under reduced pressure for 2 hours. When the mixture became viscous, the product was then air-cooled to suspend the reaction. The resulting resin was then used as crystalline polyester resin D.

The crystalline polyester resin D thus obtained had a weight-average molecular weight (Mw) of 24,000 and a number-average molecular weight (Mn) of 13,000 as determined by gel permeation chromatography (GPC) (in polystyrene equivalence).

The crystalline polyester resin D was measured for melting point (Tm) by DSC. As a result, the crystalline polyester resin D showed a definite peak. The peak top was at 95° C.

Crystalline Polyester Resin E: TPA/ND/BPA=50/47.5/2.5

Into a three-necked flask which had been heated and dried were charged 194 parts by weight of dimethyl terephthalate, 152 parts by weight of 1,9-nonanediol, 15.8 parts by weight of bisphenol A-ethylene oxide adduct, 136 parts by weight of ethylene glycol and 0.15 parts by weight of dibutyl tin oxide as a catalyst. The air in the vessel was replaced by nitrogen gas by a pressure reduction method to form an inert atmosphere in which the mixture was then mechanically stirred at 180° C. for 5 hours. The resulting methanol and excessive ethylene glycol were then distilled off under reduced pressure. Thereafter, the mixture was gradually heated to 220° C. with stirring under reduced pressure for 2 hours. When the mixture became viscous, the product was then air-cooled to suspend the reaction. The resulting resin was then used as crystalline polyester resin E.

The crystalline polyester resin E thus obtained had a weight-average molecular weight (Mw) of 43,000 and a number-average molecular weight (Mn) of 22,000 as determined by gel permeation chromatography (GPC) (in polystyrene equivalence).

The crystalline polyester resin E was measured for melting point (Tm) by DSC. As a result, the crystalline polyester resin E showed a definite peak. The peak top was at 96° C.

The crystalline polyester resins A to E thus prepared are tabulated in FIG. 7.

[Preparation of Amorphous Polyester Resins]

Amorphous Polyester Resin F: TPA/ND/BPA=50/12.5/37.5

Into a three-necked flask which had been heated and dried were charged 194 parts by weight of dimethyl terephthalate, 40 parts by weight of 1,9-nonanediol, 237 parts by weight of bisphenol A-ethylene oxide adduct, and 0.15 parts by weight of dibutyl tin oxide as a catalyst. The air in the vessel was replaced by nitrogen gas by a pressure reduction method to form an inert atmosphere in which the mixture was then mechanically stirred at 180° C. for 5 hours.

Thereafter, the mixture was gradually heated to 230° C. with stirring under reduced pressure for 2 hours. When the mixture became viscous, the product was then air-cooled to suspend the reaction. The resulting resin was then used as amorphous polyester resin F.

The amorphous polyester resin F thus obtained had a weight-average molecular weight (Mw) of 13,000 and a number-average molecular weight (Mn) of 6,000 as determined by gel permeation chromatography (GPC) (in polystyrene equivalence).

The amorphous polyester resin F was measured for melting point (Tm) by DSC. As a result, the crystalline polyester resin F showed no definite peak, demonstrating that it had a stepwise endothermic change. The glass transition point (Tg) of the amorphous polyester resin F defined by the middle point in the stepwise endothermic change was 58° C.

Amorphous Polyester Resin G: TPA/ND/BPA=50/7.5/42.5

Into a three-necked flask which had been heated and dried were charged 194 parts by weight of dimethyl terephthalate, 47 parts by weight of 1,9-nonanediol, 136 parts by weight of bisphenol A-ethylene oxide adduct, and 0.15 parts by weight of dibutyl tin oxide as a catalyst. The air in the vessel was replaced by nitrogen gas by a pressure reduction method to form an inert atmosphere in which the mixture was then mechanically stirred at 180° C. for 5 hours.

Thereafter, the mixture was gradually heated to 230° C. with stirring under reduced pressure for 2 hours. When the mixture became viscous, the product was then air-cooled to suspend the reaction. The resulting resin was then used as amorphous polyester resin G.

The amorphous polyester resin G thus obtained had a weight-average molecular weight (Mw) of 12,000 and a number-average molecular weight (Mn) of 5, 600 as determined by gel permeation chromatography (GPC) (in polystyrene equivalence).

The amorphous polyester resin G was measured for melting point (Tm) by DSC. As a result, the crystalline polyester resin G showed no definite peak, demonstrating that it had a stepwise endothermic change. The glass transition point (Tg) of the amorphous polyester resin G defined by the middle point in the stepwise endothermic change was 62° C.

Amorphous Polyester Resin H: TPA/BPA=50/50

Into a three-necked flask which had been heated and dried were charged 194 parts by weight of dimethyl terephthalate, 316 parts by weight of bisphenol A-ethylene oxide adduct, and 0.15 parts by weight of dibutyl tin oxide as a catalyst. The air in the vessel was replaced by nitrogen gas by a pressure reduction method to form an inert atmosphere in which the mixture was then mechanically stirred at 180° C. for 5 hours.

Thereafter, the mixture was gradually heated to 230° C. with stirring under reduced pressure for 2 hours. When the mixture became viscous, the product was then air-cooled to suspend the reaction. The resulting resin was then used as amorphous polyester resin H.

The amorphous polyester resin H thus obtained had a weight-average molecular weight (Mw) of 13,000 and a number-average molecular weight (Mn) of 6,000 as determined by gel permeation chromatography (GPC) (in polystyrene equivalence).

The amorphous polyester resin H was measured for melting point (Tm) by DSC. As a result, the crystalline polyester resin H showed no definite peak, demonstrating that it had a stepwise endothermic change. The glass transition point (Tg) of the amorphous polyester resin H defined by the middle point in the stepwise endothermic change was 82° C.

Amorphous Polyester Resin I: TPA/BPA/CHDM=50/40/10

Here, CHDM means cyclohexane dimethanol.

Into a three-necked flask which had been heated and dried were charged 194 parts by weight of dimethyl terephthalate, 253 parts by weight of bisphenol A-ethylene oxide adduct, 28.8 parts by weight of cyclohexane dimethanol, and 0.15 parts by weight of dibutyl tin oxide as a catalyst. The air in the vessel was replaced by nitrogen gas by a pressure reduction method to form an inert atmosphere in which the mixture was then mechanically stirred at 180° C. for 5 hours.

Thereafter, the mixture was gradually heated to 230° C. with stirring under reduced pressure for 2 hours. When the mixture became viscous, the product was then air-cooled to suspend the reaction. The resulting resin was then used as amorphous polyester resin I.

The amorphous polyester resin I thus obtained had a weight-average molecular weight (Mw) of 13,000 and a number-average molecular weight (Mn) of 6,000 as determined by gel permeation chromatography (GPC) (in polystyrene equivalence).

The amorphous polyester resin I was measured for melting point (Tm) by DSC. As a result, the crystalline polyester resin I showed no definite peak, demonstrating that it had a stepwise endothermic change. The glass transition point (Tg) of the amorphous polyester resin I defined by the middle point in the stepwise endothermic change was 65° C.

The amorphous polyester resins F to I thus prepared are tabulated in FIG. 8.

Example 1

Color Toner Developer

As a thermoplastic resin there was used a 5:4:1 (by mole) of terephthalic acid, bisphenol A-ethylene oxide adduct and linear polyester obtained from cyclohexane dimethanol (Tg: 62° C.; Mn: 4,500; Mw: 10,000). To 100 parts by weight of this thermoplastic resin were then added 5 parts by weight of benzidine yellow as a colorant for yellow toner, 4 parts by weight of pigment red as a colorant for magenta toner, 4 parts by weight of phthalocyanine blue as a colorant for cyan toner or 5 parts by weight of carbon black as a colorant for black toner. These mixtures were each then heated and melt-mixed in a Banbury mixer, ground using a jet mill, and then classified using an air classifier to prepare a particulate material having d50 of 7 μm.

To 100 parts by weight of the aforementioned particulate material were then added the following two inorganic particulate materials a and b. These components were then mixed using a high speed mixer so that the inorganic particulate materials were attached to the surface of the particulate material.

The inorganic particulate material a was silica (hydrophobicized with a silane coupling agent on the surface thereof; average particle diameter: 0.05 μm; added amount: 1.0 parts by weight). The inorganic particulate material b was titanium dioxide (hydrophobicized with a silane coupling agent on the surface thereof; average particle diameter: 0.02 μm; refractive index: 2.5; added amount: 1.0 parts by weight).

100 parts by weight of the same carrier as that for black developer for Acolor635 (produced by Fuji Xerox Co., Ltd.) and 8 parts by weight of the aforementioned toner were then mixed to prepare a two-component developer.

—Transparent Toner Developer—

As a thermoplastic resin there was used a 5:4:1 (by mole) of terephthalic acid, bisphenol A-ethylene oxide adduct and linear polyester obtained from cyclohexane dimethanol (Tg: 62° C.; Mn: 4,500; Mw: 10,000). This thermoplastic resin was ground using a jet mill, and then classified using an air classifier to prepare a particulate material having d50 of 6 μm.

To 100 parts by weight of the aforementioned particulate material were then added the following two inorganic particulate materials a and b. These components were then mixed using a high speed mixer so that the inorganic particulate materials were attached to the surface of the particulate material.

The inorganic particulate material a was silica (hydrophobicized with a silane coupling agent on the surface thereof; average particle diameter: 0.05 μm; added amount: 1.0 parts by weight). The inorganic particulate material b was titanium dioxide (hydrophobicized with a silane coupling agent on the surface thereof; average particle diameter: 0.02 μm; refractive index: 2.5; added amount: 1.0 parts by weight).

100 parts by weight of the same carrier as that for black developer for Acolor635 (produced by Fuji Xerox Co., Ltd.) and 8 parts by weight of the aforementioned toner were then mixed to prepare a two-component developer.

—Image Support—

(Raw Paper)

As a raw paper there was one having a thickness of 150 μm made of pulp.

(Light-Scattering Layer)

100 parts by weight of a polyethylene resin were mixed with 25 parts by weight of titanium dioxide (KA-10, produced by Titan Kogyo K.K.; particle diameter: 300 to 500 nm). The mixture was charged in a melt-extruder which had been heated to 200° C. from which it was then extruded through T-die and laminated on the surface of the raw paper which had been flame-treated while being nipped between a nip roll and a cooling roll to prepare a light-scattering layer to a thickness of 30 μm. The film thus extruded through T-die was then corona-discharged on the both sides thereof using a corona treatment apparatus.

(Color Toner-Receiving Layer)

50 parts by weight of the crystalline polyester resin A and 50 parts by weight of the amorphous polyester resin F were melt-kneaded in an extrusion kneader which had been heated to 190° C. for 10 minutes. The resulting pelletized resin was charged in a melt-extruder which had been heated to 170° C. from which it was then extruded through T-die and laminated on the surface of the raw paper having a light-scattering layer formed thereon while being nipped between a nip roll and a cooling roll to prepare a color toner-receiving layer to a thickness of 20 μm. When $t_0$ in the melt-mixing of resin was 5 minutes, the temperature $T_0$ at which the luminous reflectance Y is 1.5% was 185° C. In the color toner-receiving layer thus prepared, Tm was 90° C.

(Preparation of Back Side Layer)

A polyethylene resin was charged in a melt-extruder which had been heated to 200° C. from which it was then extruded through a T-die and laminated on the back side of the raw paper which had been flame-treated while being nipped between a nip roll and a cooling roll to form a polyethylene layer to a thickness of 30 μm. A colloidal silica was then spread over the polyethylene layer as an antistatic agent using a bar coater to prepare an antistatic layer. The film thus extruded through T-die was then corona-discharged on the both sides thereof using a corona treatment apparatus.

—Color Image-Forming Apparatus—

Figure 2:
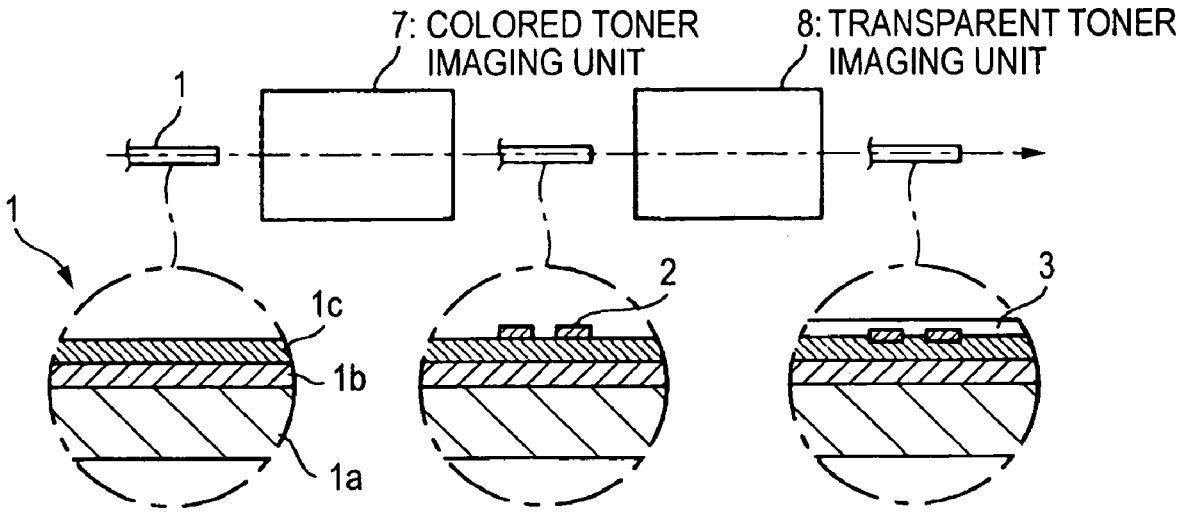
FIG. 2 is a diagram illustrating an outline of the image-forming apparatus according to the invention.

As an image-forming apparatus there was used the aforementioned color image-forming apparatus shown in FIG. 2. The speed of image forming process except fixing step was 160 mm/s. The transparent toner, the cyan toner, the magenta toner, the yellow toner and the black toner were sequentially developed in this order. The weight proportion of the toner and the carrier, the charged potential of photoreceptor, the exposure, and the development bias were adjusted such that the amount of the color toners to be developed on the solid image area were each 0.7 mg/cm$^2$. The transparent toner was uniformly developed on the entire surface thereof. The weight proportion of the toner and the carrier, the charged potential of photoreceptor, the exposure, and the development bias were adjusted such that the amount of the toner to be developed on the solid image area was 0.6 mg/cm$^2$. The transparent toner image thus formed had a thickness of about 5 μm after fixing.

—Belt Substrate—

As a belt substrate there was used one obtained by spreading a Type KE4895 silicone RTV rubber (produced by Shin-Etsu Chemical Co., Ltd.) over a polyimide film having a thickness of 80 μm with an electrically-conductive particulate carbon dispersed therein to a thickness of 50 μm.

As two heating rollers there were each used one obtained by providing a silicone rubber layer on a core made of aluminum to a thickness of 2 mm. The heating rollers each had a halogen lamp provided in the center thereof as a heat source. The temperature of the surface of the rollers were each 135° C.

The fixing speed was 20 mm/s.

The ultimate temperature of the fixing unit was 110° C. At this temperature, the viscosity of the polyolefin-based resin in the light-scattering layer, the resin in the color toner-receiving layer, the transparent toner and the color toner were $10^5$ Pa·s, $5\times10^2$ Pa·s, $2\times10^3$ Pa·s and $3\times10^3$ Pa·s, respectively.

The temperature of the image support at the peeling site on the fixing unit was 70° C.

Using the aforementioned apparatus, a portrait photographic image was outputted.

The toner materials used were evaluated in the following manners.

For the measurement of molecular weight, GPC was used. As a solvent there was used THF.

For the measurement of average particle diameter of toner, a coulter counter was used. d50 of weight mean was applied.

For the measurement of viscosity of resin, a rotary flat plate type rheometer (produced by Rheometrix Corporation) was used. The measurement was made at an angular velocity of 1 rad/s.

The measurement of Y was effected in the following procedure (see FIG. 5).

The thermoplastic resins for forming color toner-receiving layer obtained in the aforementioned examples and the examples and comparative examples described later were each spread over a color OHP sheet (produced by Fuji Xerox Co., Ltd.) to the same thickness as in the respective example to prepare a transparent image.

A cover glass sheet for microscopic observation was superposed on the surface and back surface of the transparent image. The gap between the image and the cover glass sheets were each filled with tetradecane.

The laminate was then placed on a light trap to be subjected to colorimetry with X-Rite 968 to measure Y'.

A cover glass sheet for microscopic observation was superposed on the surface and back surface of an OHP sheet having no thermoplastic resin spread thereover. The gap between the image and the cover glass sheets were each then filled with tetradecane. The laminate was then measured for $Y_0$ in the same manner as mentioned above.

Y was calculated by the equation $Y'-Y_0$.

Example 2

A color image was prepared in the same manner as in Example 1 except that the color toner-receiving layer was changed as follows.

(Color Toner-Receiving Layer)

40 parts by weight of the crystalline polyester resin A and 60 parts by weight of the amorphous polyester resin F were melt-kneaded in an extrusion kneader which had been heated to 190° C. for 10 minutes. The resulting pelletized resin was charged in a melt-extruder which had been heated to 170° C. from which it was then extruded through T-die and laminated on the surface of the raw paper having a light-scattering layer formed thereon while being nipped between a nip roll and a cooling roll to prepare a color toner-receiving layer to a thickness of 20 μm. When $t_0$ in the melt-mixing of resin was 5 minutes, the temperature $T_0$ was 190° C. At the ultimate temperature of 110° C. of the fixing unit, this resin exhibited a viscosity of $10^3$ Pa·s.

Example 3

A color image was prepared in the same manner as in Example 1 except that the color toner-receiving layer was changed as follows.

(Color Toner-Receiving Layer)

60 parts by weight of the crystalline polyester resin A and 40 parts by weight of the amorphous polyester resin F were melt-kneaded in an extrusion kneader which had been heated to 190° C. for 10 minutes. The resulting pelletized resin was charged in a melt-extruder which had been heated to 170° C. from which it was then extruded through T-die and laminated on the surface of the raw paper having a light-scattering layer formed thereon while being nipped between a nip roll and a cooling roll to prepare a color toner-receiving layer to a thickness of 20 μm. When $t_0$ in the melt-mixing of resin was 5 minutes, the temperature $T_0$ was 180° C. At the ultimate temperature of 110° C. of the fixing unit, this resin exhibited a viscosity of $3\times10^2$ Pa·s.

Example 4

A color image was prepared in the same manner as in Example 1 except that the color toner-receiving layer was changed as follows.

(Color Toner-Receiving Layer)

50 parts by weight of the crystalline polyester resin B and 50 parts by weight of the amorphous polyester resin F were melt-kneaded in an extrusion kneader which had been heated to 190° C. for 10 minutes. The resulting pelletized resin was charged in a melt-extruder which had been heated to 170° C. from which it was then extruded through T-die and laminated on the surface of the raw paper having a light-scattering layer formed thereon while being nipped between a nip roll and a cooling roll to prepare a color toner-receiving layer to a thickness of 20 μm. When $t_0$ in the melt-mixing of resin was 5 minutes, the temperature $T_0$ was 170° C. At the ultimate temperature of 110° C. of the fixing unit, this resin exhibited a viscosity of $5\times10^2$ Pa·s.

Example 5

A color image was prepared in the same manner as in Example 1 except that the color toner-receiving layer was changed as follows.

(Color Toner-Receiving Layer)

50 parts by weight of the crystalline polyester resin C and 50 parts by weight of the amorphous polyester resin F were melt-kneaded in an extrusion kneader which had been heated to 190° C. for 10 minutes. The resulting pelletized resin was charged in a melt-extruder which had been heated to 170° C. from which it was then extruded through T-die and laminated on the surface of the raw paper having a light-scattering layer formed thereon while being nipped between a nip roll and a cooling roll to prepare a color toner-receiving layer to a thickness of 20 μm. When $t_0$ in the melt-mixing of resin was 5 minutes, the temperature $T_0$ was 165° C. At the ultimate temperature of 110° C. of the fixing unit, this resin exhibited a viscosity of $10^3$ Pa·s.

Example 6

A color image was prepared in the same manner as in Example 1 except that the color toner-receiving layer was changed as follows.

(Color Toner-Receiving Layer)

50 parts by weight of the crystalline polyester resin D and 50 parts by weight of the amorphous polyester resin F were melt-kneaded in an extrusion kneader which had been heated to 185° C. for 10 minutes. The resulting pelletized resin was charged in a melt-extruder which had been heated to 170° C. from which it was then extruded through T-die and laminated on the surface of the raw paper having a light-scattering layer formed thereon while being nipped between a nip roll and a cooling roll to prepare a color toner-receiving layer to a thickness of 20 μm. When $t_0$ in the melt-mixing of resin was 5 minutes, the temperature $T_0$ was 200° C. At the ultimate temperature of 110° C. of the fixing unit, this resin exhibited a viscosity of $10^3$ Pa·s.

Example 7

A color image was prepared in the same manner as in Example 1 except that the color toner-receiving layer was changed as follows.

(Color Toner-Receiving Layer)

50 parts by weight of the crystalline polyester resin D and 50 parts by weight of the amorphous polyester resin F were melt-kneaded in an extrusion kneader which had been heated to 210° C. for 10 minutes. The resulting pelletized resin was charged in a melt-extruder which had been heated to 170° C. from which it was then extruded through T-die and laminated on the surface of the raw paper having a light-scattering layer formed thereon while being nipped between a nip roll and a cooling roll to prepare a color toner-receiving layer to a thickness of 20 μm. When $t_0$ in the melt-mixing of resin was 5 minutes, the temperature $T_0$ was 200° C. At the ultimate temperature of 110° C. of the fixing unit, this resin exhibited a viscosity of $10^3$ Pa·s.

Example 8

A color image was prepared in the same manner as in Example 1 except that the color toner-receiving layer was changed as follows.

(Color Toner-Receiving Layer)

50 parts by weight of the crystalline polyester resin A and 50 parts by weight of the amorphous polyester resin G were melt-kneaded in an extrusion kneader which had been heated to 200° C. for 10 minutes. The resulting pelletized resin was charged in a melt-extruder which had been heated to 170° C. from which it was then extruded through T-die and laminated on the surface of the raw paper having a light-scattering layer formed thereon while being nipped between a nip roll and a cooling roll to prepare a color toner-receiving layer to a thickness of 20 μm. When $t_0$ in the melt-mixing of resin was 5 minutes, the temperature $T_0$ was 195° C. At the ultimate temperature of 110° C. of the fixing unit, this resin exhibited a viscosity of $5\times10^3$ Pa·s.

Example 9

A color image was prepared in the same manner as in Example 1 except that the color toner-receiving layer was changed as follows.

(Color Toner-Receiving Layer)

50 parts by weight of the crystalline polyester resin D and 50 parts by weight of the amorphous polyester resin I were melt-kneaded in an extrusion kneader which had been heated to 200° C. for 10 minutes. The resulting pelletized resin was charged in a melt-extruder which had been heated to 170° C. from which it was then extruded through T-die and laminated on the surface of the raw paper having a light-scattering layer formed thereon while being nipped between a nip roll and a cooling roll to prepare a color toner-receiving layer to a thickness of 20 μm. When $t_0$ in the melt-mixing of resin was 5 minutes, the temperature $T_0$ was 220° C. At the ultimate temperature of 115° C. of the fixing unit, this resin exhibited a viscosity of $5\times10^3$ Pa·s.

Example 10

A color image was prepared in the same manner as in Example 1 except that the color toner-receiving layer was changed as follows.

(Color Toner-Receiving Layer)

50 parts by weight of the crystalline polyester resin D and 50 parts by weight of the amorphous polyester resin H were melt-kneaded in an extrusion kneader which had been heated to 210° C. for 10 minutes. The resulting pelletized resin was charged in a melt-extruder which had been heated to 170° C. from which it was then extruded through T-die and laminated on the surface of the raw paper having a light-scattering layer formed thereon while being nipped between a nip roll and a cooling roll to prepare a color toner-receiving layer to a thickness of 20 μm. When $t_0$ in the melt-mixing of resin was 5 minutes, the temperature $T_0$ was 210° C. At the ultimate temperature of 110° C. of the fixing unit, this resin exhibited a viscosity of $3\times10^3$ Pa·s.

Example 11

A color image was prepared in the same manner as in Example 1 except that the color toner-receiving layer was changed as follows.

(Color Toner-Receiving Layer)

50 parts by weight of the crystalline polyester resin E and 50 parts by weight of the amorphous polyester resin H were melt-kneaded in an extrusion kneader which had been heated to 210° C. for 10 minutes. The resulting pelletized resin was charged in a melt-extruder which had been heated to 170° C. from which it was then extruded through T-die and laminated on the surface of the raw paper having a light-scattering layer formed thereon while being nipped between a nip roll and a cooling roll to prepare a color toner-receiving layer to a thickness of 20 μm. When $t_0$ in the melt-mixing of resin was 5 minutes, the temperature $T_0$ was 190° C. At the ultimate temperature of 110° C. of the fixing unit, this resin exhibited a viscosity of $10^4$ Pa·s.

Example 12

A color image was prepared in the same manner as in Example 1 except that the color toner-receiving layer was changed as follows.

(Color Toner-Receiving Layer)

50 parts by weight of the crystalline polyester resin A, 50 parts by weight of the amorphous polyester resin F and 10 parts by weight of titanium dioxide (KA-10, produced by Titan Kogyo K.K.; particle diameter: 300 to 500 nm) were melt-kneaded in an extrusion kneader which had been heated to 200° C. for 20 minutes. The resulting pelletized resin was charged in a melt-extruder which had been heated to 170° C. from which it was then extruded through T-die and laminated on the surface of the raw paper having a light-scattering layer formed thereon while being nipped between a nip roll and a cooling roll to prepare a color toner-receiving layer to a thickness of 20 μm. When $t_0$ in the melt-mixing of resin was 5 minutes, the temperature $T_0$ was 185° C. At the ultimate temperature of 110° C. of the fixing unit, this resin exhibited a viscosity of $10^3$ Pa·s.

Example 13

A color image was prepared in the same manner as in Example 1 except that the color toner and the transparent toner were changed as follows.

(Color Toner)

A color toner for DCC500 (produced by Fuji Xerox Co., Ltd.) was used. This color toner was one obtained by aggregating emulsion particles prepared by emulsion polymerization, and then heating the aggregate so that the particles are coalesced. At the ultimate temperature of 110° C. of the fixing unit, the thermoplastic resin of the color toner exhibited a viscosity of $10^4$ Pa·s.

(Transparent Toner)

A transparent toner was prepared in the same manner as the aforementioned color toner. At the ultimate temperature of 110° C. of the fixing unit, the thermoplastic resin of the transparent toner exhibited a viscosity of $5\times10^3$ Pa·s.

Example 14

A color image was prepared in the same manner as in Example 13 except that the thickness of the transparent toner image was changed to 9 μm.

Example 15

A color image was prepared in the same manner as in Example 13 except that the thickness of the transparent toner image was changed to 3 μm.

Example 16

A color image was prepared in the same manner as in Example 13 except that the molecular weight of the resin to be used in the transparent toner was raised by a factor of 1.5. At the ultimate temperature of 110° C. of the fixing unit, the thermoplastic resin of the transparent toner exhibited a viscosity of $3\times10^4$ Pa·s.

Comparative Example 1

A color image was prepared in the same manner as in Example 1 except that the color toner-receiving layer was changed as follows.

(Color Toner-Receiving Layer)

The crystalline polyester resin B was charged in a melt-extruder which had been heated to 170° C. from which it was then extruded through T-die and laminated on the raw paper having a light-scattering layer formed thereon while being nipped between a nip roll and a cooling roll to form a color toner-receiving layer to a thickness of 20 μm. At the ultimate temperature of 110° C. of the fixing unit, the thermoplastic resin exhibited a viscosity of $5\times10^2$ Pa·s.

Comparative Example 2

A color image was prepared in the same manner as in Example 1 except that the color toner-receiving layer was changed as follows.

(Color Toner-Receiving Layer)

The crystalline polyester resin D was charged in a melt-extruder which had been heated to 170° C. from which it was then extruded through T-die and laminated on the raw paper having a light-scattering layer formed thereon while being nipped between a nip roll and a cooling roll to form a color toner-receiving layer to a thickness of 20 μm. At the ultimate temperature of 110° C. of the fixing unit, the thermoplastic resin exhibited a viscosity of $8\times10^2$ Pa·s.

Comparative Example 3

A color image was prepared in the same manner as in Example 1 except that the color toner-receiving layer was changed as follows.

(Color Toner-Receiving Layer)

The crystalline polyester resin E was charged in a melt-extruder which had been heated to 170° C. from which it was then extruded through T-die and laminated on the raw paper having a light-scattering layer formed thereon while being nipped between a nip roll and a cooling roll to form a color toner-receiving layer to a thickness of 20 μm. At the ultimate temperature of 110° C. of the fixing unit, the thermoplastic resin exhibited a viscosity of $8\times10^3$ Pa·s.

Comparative Example 4

A color image was prepared in the same manner as in Example 1 except that the color toner-receiving layer was changed as follows.

(Color Toner-Receiving Layer)

The amorphous polyester resin H was charged in a melt-extruder which had been heated to 220° C. from which it was then extruded through T-die and laminated on the raw paper having a light-scattering layer formed thereon while being nipped between a nip roll and a cooling roll to form a color toner-receiving layer to a thickness of 20 μm. At the ultimate temperature of 110° C. of the fixing unit, the thermoplastic resin exhibited a viscosity of $10^4$ Pa·s.

Comparative Example 5

A color image was prepared using the same apparatus as used in Example 1 except that the substrate for image support was changed to a mirror coat gold paper (210 gsm, produced by Oji paper Co., Ltd.).

Comparative Example 6

A color image was prepared using the same apparatus as used in Example 1 except that the substrate for image support was changed to a J paper (produced by Fuji Xerox Co., Ltd.).

Comparative Example 7

A color image was prepared using the same apparatus as used in Example 1 except that the image support had no color toner-receiving layer formed thereon.

Comparative Example 8

A color image was prepared using the same apparatus as used in Example 13 except that no transparent toner image was formed.

Comparative Example 9

A color image was prepared using the same apparatus as used in Example 13 except that the thickness of the transparent toner image was 15 μm.

Comparative Example 10

A color image was prepared using the same apparatus as used in Example 13 except that the thickness of the transparent toner image was 1.8 μm.

(Evaluation of Image)

—Mechanical Strength—

The image structures obtained in the examples and the comparative examples were each wound up on metallic rolls having different radii. The minimum radius at which no crack occurs was then examined. The evaluation by minimum radius was made according to the following criteria.

Less than 10 mm: G (good)
From not smaller than 10 mm
to less than 30 mm: F (fair)
Not smaller than 30 mm: P (poor)

—Heat Resistance—

The image structures obtained in the examples and comparative examples were each superposed on each other in such an arrangement that the surface of one image structure comes in contact with the back surface of another. The laminates were each then put in a constant temperature tank kept at a predetermined temperature while being under a load of 30 g/cm$^2$. After 3 days of aging, the laminates were each then returned to room temperature (about 22° C.) where they were each then subjected to peeling. This temperature was repeated with the ambient temperature varied. The evaluation of heat resistance was made by the temperature at which the surface of image was destroyed according to the following criteria.

Not lower than 50° C.: G (good)
From not lower than 40° C. to
less than 50° C.: F (fair)
Not higher than 40° C.: P (poor)

—Evaluation of Gloss—

The images obtained in the examples and comparative examples were each measured for gloss on cyan halftone image area having a percent area of 50% using a 75 degree glossmeter (produced by MURAKAMI COLOR RESEARCH LABORATORY CO., Ltd.). The evaluation of gloss was made by the fixing temperature at which the gloss was 90 or more according to the following criteria.

Not smaller than 80: G (good)
From not smaller than 60 to
less than 80: F (fair)
Not greater than 60: P (poor)

—Evaluation of Smoothness—

The images obtained in the examples and comparative examples were each visually observed for smoothness. The criteria of evaluation were as follows.

Neither bubbles nor image steps
observed on image surface: G (good)
Bubbles or image steps observed
but acceptable: F (fair)
Bubbles and image steps remarkable
and unacceptable: P (poor)

—Evaluation of Granularity—

The images obtained in the examples and comparative examples were each visually observed for granularity at a distance of 40 cm. The evaluation of granularity was made according to the following criteria.

No granularity observed visually: G (good)
Slight granularity visually
observed but not offensive: F (fair)
Definite granularity observed visually: P (poor)

—Comprehensive Image Quality—

The images obtained at a fixing temperature of 140° C. in the examples and comparative examples were each evaluated for comprehensive desirableness according to the following 5-step criterion.

Very desirable: 5 scores
Desirable: 4 scores
Ordinary: 3 scores
Undesirable: 2 scores
Very undesirable: 1 score Ten testers joined the evaluation. The scores obtained by the ten testers were then averaged.

Not smaller than 3.5 scores: G (good)
Not smaller than 2.5 scores to less than 3.5 scores: F (fair)

Less than 2.5 scores: P (poor)

The results of the image evaluation are shown in FIGS. 9 and 10.

As can be seen in FIG. 9, the images of Examples 1 to 16 are satisfactory all in mechanical strength, heat resistance, gloss, smoothness and granularity. These images show a high comprehensive image quality and thus are desirable.

The images of Examples 10 and 11 are somewhat poor all in mechanical strength, heat resistance, gloss, smoothness and granularity but are practically acceptable.

Referring to the luminous reflectance Y, the image of Example 6 exhibits a luminous reflectance Y as high as 2.5 and hence a somewhat poor compatibility but is practically acceptable as a result of evaluation of image quality.

The results of Examples 13 and 16 show that the reduction of the melt viscosity of the resin of the transparent toner makes it possible to give a better granularity and hence a better image quality.

On the contrary, as shown in FIG. 10, the images of Comparative Examples 1 to 10 are practically unacceptable in at least two of mechanical strength, heat resistance, gloss, smoothness and granularity. All these images are undesirable as a result of evaluation of comprehensive image quality.

As can be seen in the comparison of Example 1 with Example 13, the use of EA toner rather than ground toner makes it possible to improve granularity and comprehensive image quality.

As can be seen in the results of Examples 13 to 15, even when the thickness of the transparent toner image is reduced, the deterioration of image quality can be suppressed.

On the other hand, as can be seen in the results of Comparative Examples 1 to 10, the single use of a crystalline polyester resin or amorphous polyester resin as a color toner-receiving layer (Comparative Examples 1 to 4) causes the deterioration of gloss and smoothness. Further, as can be seen in the results of Comparative Examples 5 and 6, the image smoothness is affected by the raw paper used. Moreover, as can be seen in the results of Comparative Example 7, the absence of color toner-receiving layer causes the deterioration of gloss and smoothness. It was also confirmed that even when as a toner there is used EA toner, the granularity, etc are affected by the thickness of the transparent toner image, causing the deterioration of image quality (Comparative Examples 8 to 10).

As can be seen in the aforementioned description, the use of Examples 1 to 16 makes it possible to provide an image forming method capable of giving a desirable image which is satisfactory all in mechanical strength, heat resistance, gloss, smoothness and granularity and exhibits a high solidification rate and a high comprehensive image quality and an image-forming apparatus using same.

Example 17

Color Toner Developer

As a thermoplastic resin there was used a 5:4:1 (by mole) of terephthalic acid, bisphenol A-ethylene oxide adduct and linear polyester obtained from cyclohexane dimethanol (glass transition point Tg: 62° C.; number-average molecular weight Mn: 4,500; weight-average molecular weight Mw: 10,000). To 100 parts by weight of this thermoplastic resin were then added 5 parts by weight of benzidine yellow as a colorant for yellow toner, 4 parts by weight of pigment red as a colorant for magenta toner, 4 parts by weight of phthalocyanine blue as a colorant for cyan toner or 5 parts by weight of carbon black as a colorant for black toner. These mixtures were each then heated and melt-mixed in a Banbury mixer, ground using a jet mill, and then classified using an air classifier to prepare a particulate material having d50 of 7 μm.

To 100 parts by weight of the aforementioned particulate material were then added the following two inorganic particulate materials a and b. These components were then mixed using a high speed mixer so that the inorganic particulate materials were attached to the surface of the particulate material.

The inorganic particulate material a was silica (hydrophobicized with a silane coupling agent on the surface thereof; average particle diameter: 0.05 μm; added amount: 1.0 parts by weight). The inorganic particulate material b was titanium dioxide (hydrophobicized with a silane coupling agent on the surface thereof; average particle diameter: 0.02 μm; refractive index: 2.5; added amount: 1.0 parts by weight).

100 parts by weight of the same carrier as that for black developer for Acolor635 (produced by Fuji Xerox Co., Ltd.) and 8 parts by weight of the aforementioned toner were then mixed to prepare a two-component developer.

—Transparent Toner Developer—

As a thermoplastic resin there was used a 5:4:1 (by mole) of terephthalic acid, bisphenol A-ethylene oxide adduct and linear polyester obtained from cyclohexane dimethanol (Tg: 62° C.; Mn: 4,500; Mw: 10,000). This thermoplastic resin was ground using a jet mill, and then classified using an air classifier to prepare a particulate material having d50 of 6 μm.

To 100 parts by weight of the aforementioned particulate material were then added the following two inorganic particulate materials a and b. These components were then mixed using a high speed mixer so that the inorganic particulate materials were attached to the surface of the particulate material.

The inorganic particulate material a was silica (hydrophobicized with a silane coupling agent on the surface thereof; average particle diameter: 0.05 μm; added amount: 1.0 parts by weight). The inorganic particulate material b was titanium dioxide (hydrophobicized with a silane coupling agent on the surface thereof; average particle diameter: 0.02 μm; refractive index: 2.5; added amount: 1.0 parts by weight).

100 parts by weight of the same carrier as that for black developer for Acolor635 (produced by Fuji Xerox Co., Ltd.) and 8 parts by weight of the aforementioned toner were then mixed to prepare a two-component developer.

—Image Support—

(Raw Paper)

As a raw paper there was one having a thickness of 150 μm made of pulp.

(Light-Scattering Layer)

100 parts by weight of a polyethylene resin were mixed with 25 parts by weight of titanium dioxide (KA-10, produced by Titan Kogyo K.K.; particle diameter: 300 to 500 nm). The mixture was charged in a melt-extruder which had been heated to 200° C. from which it was then extruded through T-die and laminated on the surface of the raw paper which had been flame-treated while being nipped between a nip roll and a cooling roll to prepare a light-scattering layer to a thickness of 30 μm. The film thus extruded through T-die was then corona-discharged on the both sides thereof using a corona treatment apparatus. The temperature T at which the light-scattering layer exhibits a viscosity of $5\times10^3$ Pa·s Was 130° C.

(Color Toner-Receiving Layer)

Into a three-necked flask which had been heated and dried were charged 194 parts by weight of dimethyl terephthalate, 316 parts by weight of bisphenol A-ethylene oxide adduct, and 0.15 parts by weight of dibutyl tin oxide as a catalyst. The air in the vessel was replaced by nitrogen gas by a pressure reduction method to form an inert atmosphere in which the mixture was then mechanically stirred at 180° C. for 5 hours.

Thereafter, the mixture was gradually heated to 230° C. with stirring under reduced pressure for 2 hours. When the mixture became viscous, the product was then air-cooled to suspend the reaction.

The amorphous polyester resin thus obtained had Mw of 13,000 and Mn of 6,000 in polystyrene equivalence. The amorphous polyester resin showed a glass transition point Tg of 82° C. as measured using a differential scanning calorimeter (DSC).

The amorphous polyester resin thus obtained was melt-kneaded in an extrusion kneader which had been heated to 190° C. for 10 minutes. The resulting pelletized resin was charged in a melt-extruder which had been heated to 170° C. from which it was then extruded through T-die and laminated on the surface of the raw paper having a light-scattering layer formed thereon while being nipped between a nip roll and a cooling roll to prepare a color toner-receiving layer to a thickness of 20 μm.

(Preparation of Back Side Layer)

A polyethylene resin was charged in a melt-extruder which had been heated to 200° C. from which it was then extruded through a T-die and laminated on the back side of the raw paper which had been flame-treated while being nipped between a nip roll and a cooling roll to form a polyethylene layer to a thickness of 30 μm. A colloidal silica was then spread over the polyethylene layer as an antistatic agent using a bar coater to prepare an antistatic layer. The film thus extruded through T-die was then corona-discharged on the both sides thereof using a corona treatment apparatus.

—Color Image-Forming Apparatus—

As an image-forming apparatus there was used the aforementioned color image-forming apparatus shown in FIG. 2. The speed of image forming process except fixing step was 160 mm/s. The transparent toner, the cyan toner, the magenta toner, the yellow toner and the black toner were sequentially developed in this order. The weight proportion of the toner and the carrier, the charged potential of photoreceptor, the exposure, and the development bias were adjusted such that the amount of the color toners to be developed on the solid image area were each 0.6 mg/cm$^2$. The transparent toner was uniformly developed on the entire surface thereof. The weight proportion of the toner and the carrier, the charged potential of photoreceptor, the exposure, and the development bias were adjusted such that the amount of the toner to be developed on the solid image area was 0.6 mg/cm$^2$. The transparent toner image thus formed had a thickness of about 5 μm after fixing.

—Belt Substrate—

As a belt substrate there was used one obtained by spreading a Type KE4895 silicone RTV rubber (produced by Shin-Etsu Chemical Co., Ltd.) over a polyimide film having a thickness of 80 μm with an electrically-conductive particulate carbon dispersed therein to a thickness of 50 μm.

As two heating rollers there were each used one obtained by providing a silicone rubber layer on a core made of aluminum to a thickness of 2 mm. The heating rollers each had a halogen lamp provided in the center thereof as a heat source. The temperature of the surface of the rollers were each 125° C.

The fixing speed was 15 mm/s.

The ultimate temperature of the fixing unit was 115° C. At this temperature, the viscosity of the polyolefin-based resin in the light-scattering layer, the resin in the color toner-receiving layer, the transparent toner and the color toner were $10^4$ Pa·s, $7\times10^3$ Pa·s, $3\times10^2$ Pa·s and $5\times10^2$ Pa·s, respectively.

The temperature of the image support at the peeling site on the fixing unit was 70° C.

Using the aforementioned apparatus, a portrait photographic image was outputted.

The toner materials used were evaluated in the following manners.

For the measurement of molecular weight, gel permeation chromatography (GPC) was used. As a solvent there was used THF.

For the measurement of average particle diameter of toner, a coulter counter (produced by Coulter Counter Inc.) was used. d50 of weight mean was applied.

For the measurement of viscosity of resin, a rotary flat plate type rheometer (produced by Rheometrix Corporation) was used. The measurement was made at an angular velocity of 1 rad/s.

Example 18

A color image was prepared in the same manner as in Example 17 except that the thickness of the transparent toner image was changed to 9 μm.

Example 19

A color image was prepared in the same manner as in Example 17 except that the thickness of the transparent toner image was changed to 3 μm.

Example 20

A color image was prepared in the same manner as in Example 17 except that the color toner and the transparent toner were changed as follows.

(Color Toner)

A color toner for DCC500 (produced by Fuji Xerox Co., Ltd.) was used. This color toner was one obtained by aggregating emulsion particles prepared by emulsion polymerization, and then heating the aggregate so that the particles are coalesced. At the ultimate temperature of 115° C. of the fixing unit, the thermoplastic resin of the color toner exhibited a viscosity of $10^4$ Pa·s.

(Transparent Toner)

A transparent toner was prepared in the same manner as the aforementioned color toner except that no pigments were incorporated therein. At the ultimate temperature of 115° C. of the fixing unit, the thermoplastic resin of the transparent toner exhibited a viscosity of $5\times10^3$ Pa·s.

Example 21

A color image was prepared in the same manner as in Example 20 except that the molecular weight of the thermoplastic resin to be used in the transparent toner was raised by a factor of 1.5. At the ultimate temperature of 115° C. of the fixing unit, the thermoplastic resin of the transparent toner exhibited a viscosity of $3\times10^4$ Pa·s.

Comparative Example 11

A color image was prepared in the same manner as in Example 17 except that the color toner-receiving layer was not provided.

Comparative Example 12

A color image was prepared in the same manner as in Example 17 except that the transparent toner image was not provided.

Comparative Example 13

A color image was prepared using the same apparatus as used in Example 17 except that the thickness of the transparent toner image was 15 μm.

Comparative Example 14

A color image was prepared using the same apparatus as used in Example 17 except that the thickness of the transparent toner image was 1.8 μm.

Comparative Example 15

A color image was prepared in the same manner as in Example 17 except that as the resin to be used in the color toner-receiving layer there was used the same color toner resin as used in Example 17.

(Evaluation of Image)

—Image Support Conveyability—

Two sheets of the image support having no images formed thereon were superposed on each other in such an arrangement that the surface of one image support and the back surface of the other are opposed to each other. The laminates were each then put in a constant temperature tank kept at a predetermined temperature while being under a load of 30 g/cm$^2$. After 3 days of aging, the laminates were each then returned to room temperature (about 22° C.) where an image was then formed thereon. This procedure was repeated with the temperature of the constant temperature tank varied. The evaluation of heat resistance was made by the temperature at which double feed of papers occurs according to the following criteria.

Not lower than 50° C.: G (good)
From not lower than 40° C. to
less than 50° C.: F (fair)
Not higher than 40° C.: P (poor)

—Heat Resistance—

The image structures obtained in the examples and comparative examples were each superposed on each other in such an arrangement that the surface of one image structure comes in contact with the back surface of another. The laminates were each then put in a constant temperature tank kept at a predetermined temperature while being under a load of 30 g/cm$^2$. After 3 days of aging, the laminates were each then returned to room temperature (about 22° C.) where they were each then subjected to peeling. This examination was repeated with the ambient temperature varied. The evaluation of heat resistance was made by the temperature at which the surface of image was destroyed according to the following criteria.

Not lower than 55° C.: G (good)
From not lower than 45° C. to
less than 55° C.: F (fair)
Not higher than 45° C.: P (poor)

—Evaluation of Smoothness—

The images obtained in the examples and comparative examples were each visually observed for smoothness. The criteria of evaluation were as follows.

No image steps observed on image surface: G (good)
Image steps observed slightly but
acceptable: F (fair)
Definite image steps observed visually: P (poor)

—Evaluation of Granularity—

The images obtained in the examples and comparative examples were each visually observed for granularity at a distance of 40 cm. The evaluation of granularity was made according to the following criteria.

No granularity observed visually: G (good)
Slight granularity visually
observed but not offensive: F (fair)
Definite granularity observed visually: P (poor)

—Comprehensive Image Quality—

The images obtained at a fixing temperature of 140° C. in the examples and comparative examples were each evaluated for comprehensive desirableness according to the following 5-step criterion.

Very desirable: 5 scores
Desirable: 4 scores
Ordinary: 3 scores
Undesirable: 2 scores
Very undesirable: 1 score Ten testers joined the evaluation. The scores obtained by the ten testers were then averaged.

Not smaller than 3.5 scores: G (good)
Not smaller than 2.5 scores to
less than 3.5 scores: F (fair)
Less than 2.5 scores: P (poor)

The results of the image evaluation are shown in FIG. 11.

As can be seen in FIG. 11, the images of Examples 17 to 21 are satisfactory all in conveyability, heat resistance, smoothness and granularity. These images show a high comprehensive image quality and thus are desirable.

In the inventive examples, even when the thickness of the transparent toner image was changed to 5 μm (corresponding to Example 17), 9 μm (corresponding to Example 18) or 3 μm (corresponding to Example 19), a satisfactory image was obtained.

It was also confirmed that the use of EA toner as color toner and transparent toner (corresponding to Example 20) makes it possible to improve smoothness and granularity as compared with the use of ground toner (corresponding to Examples 17 to 19).

It was further made obvious that the reduction of the viscosity of the resin of the transparent toner leads to better granularity, making it possible to obtain a desired image quality.

On the contrary, it was confirmed that the images of Comparative Examples 11 to 14 are poor in smoothness and granularity as well as in comprehensive image quality. It was judged that this defect is greatly attributed to the effect of the color toner-receiving layer (Comparative Example 11 has no color toner-receiving layer) or the thickness of the transparent toner image (Comparative Example 12 has no transparent toner image, Comparative Example 13 has too thick a transparent toner image and Comparative Example 14 has too thin a transparent toner image).

It was further confirmed that the use of the same resin as used in the color toner image as the resin to be used in the color toner-receiving layer has little or no effect on image quality but gives difficulty in conveyance.

As can be seen in the aforementioned description, the use of Examples 17 to 21 makes it possible to provide an image structure having excellent conveyability, heat resistance, smoothness and granularity as well as good comprehensive image quality and an image-forming apparatus for forming same.

In the aforementioned technical means, the image support supplying step 4 involves supplying by a cassette or manual supplying, for example. The colored toner imaging step 5 and the transparent toner imaging step 6 are not limited in its process so far as they can form a toner image. The colored toner imaging step 5 and the transparent toner imaging step 6 may be separately or integrally provided.

Further, the image support 1 may comprise at least a light-scattering layer 1*b* and a toner-receiving layer 1*c* provided on the substrate 1*a*. Of course, the image support 1 may comprise other layers (e.g., gelatin layer, antistatic layer) provided thereon as necessary.

The substrate 1*a* may be properly selected from non-coated paper, coated paper, etc. In general, a raw paper commonly used in photographic paper may be used. In order to keep good hand touch, this raw paper preferably has a basis weight of from 100 to 250 gsm.

Moreover, the light-scattering layer 1*b* has at least a white pigment dispersed in a thermoplastic resin made of a polyolefin-based resin. As such a white pigment there may be used any white pigment such as titanium oxide, calcium carbonate and barium sulfate. Titanium oxide is preferred from the standpoint of enhancement of whiteness. The percent packing of the light-scattering layer 1*b* is preferably from 20 to 40 wt-% from the standpoint of prevention of offset and assurance of mechanical strength and smoothness.

Further, from the standpoint of assurance of heat resistance, during the fixing of the colored toner and the transparent toner on the image support 1, the viscosity of the polyolefin-based resin in the light-scattering layer 1*b* at the upper limit of fixing temperature is preferably $5\times10^3$ Pa·s or more. When the viscosity of the polyolefin-based resin falls below the above defined range, blister accompanying the bubbling caused by the heating of the substrate 1*a* can easily occur. The term "upper limit of fixing temperature" as used herein is meant to indicate the highest temperature that can be applied to the image support 1 having a colored toner image 2 and a transparent toner image 3 formed thereon during fixing.

Moreover, the toner-receiving layer 1*c* may be formed by a thermoplastic resin made of a mixture of crystalline resin and amorphous resin. The resulting toner-receiving layer can be stabilized in smoothness, heat resistance, etc.

Further, from the standpoint of assurance of heat resistance of toner-receiving layer 1*c*, the viscosity of the thermoplastic resin at the upper limit of fixing temperature is preferably $10^3$ Pa·s or less. When the viscosity of the thermoplastic resin exceeds the above defined range, the step in the image on the toner-receiving layer 1*c* (difference in height of colored toner between image area and non-image area) becomes remarkable.

Moreover, the thermoplastic resin in the toner-receiving layer 1*c* is preferably a resin obtained by melt-mixing a crystalline polyester resin and an amorphous polyester resin at a weight ratio of from 35:65 to 65:35. In this arrangement, a layer having good heat resistance and mechanical strength can be formed. When the weight proportion of the amorphous polyester resin based on the total amount of thermoplastic resins falls below 35%, the resulting toner-receiving layer exhibits a deteriorated heat resistance. On the contrary, when the weight proportion of the amorphous polyester resin exceeds 65%, the resulting toner-receiving layer exhibits a deteriorated mechanical strength. Further, the two resins can be less fairly melt-mixed with each other, making it necessary that the melting temperature during mixing be raised or the melting time be prolonged. Thus, the productivity is deteriorated and the resulting toner-receiving layer exhibits a deteriorated heat resistance.

Moreover, the conditions of melt-mixing of the crystalline polyester resin and the amorphous polyester resin are preferably predetermined such that T (° C.) is from $T_0$ to $T_0$+20 and t is from $t_0$ to $10\times t_0$ supposing that $T_0$ is the temperature at which the luminous reflectance Y of a 20 μm thick sheet formed of a resin obtained by melt-mixing a crystalline polyester resin and an amorphous polyester resin for a period of time $t_0$ (minute) is 1.5%, T is the melt-mixing temperature and t is the melt-mixing time (minute). When the temperature T during melt-mixing and the mixing time t fall below $T_0$ and $t_0$, respectively, the two resins can be insufficiently melt-mixed with each other, making it likely that the resulting toner-receiving layer 1*c* can be provided with deteriorated mechanical strength or heat resistance. On the contrary, when T exceeds $T_0$+20 or t exceeds $10\times t_0$, the plasticization of the resulting resin mixture proceeds further, making it likely that the resulting toner-receiving layer 1*c* can be provided with deteriorated heat resistance.

Further, from the standpoint of further enhancement of heat resistance and mechanical strength, the conditions of melt-mixing are preferably predetermined such that the temperature T (° C.) and the time t (minute) are from $T_0$+5 to $T_0$+10 and from to to $3\times t_0$, respectively.

Moreover, the crystalline polyester resin and the amorphous polyester resin preferably comprise common alcohol derivatives or acid derivatives from the standpoint of further enhancement of melt-miscibility.

Referring to a preferred embodiment of the alcohol derivatives and acid derivatives constituting the crystalline polyester resin, the alcohol derivatives constituting the crystalline polyester resin are mainly composed of a $C_6$-$C_{12}$ straight-chain aliphatic group, the straight-chain aliphatic group accounts for all the alcohol derivatives in a proportion of from 85 to 98 mol %, the acid derivatives constituting the crystalline polyester resin are mainly composed of an aromatic group derived from terephthalic acid, isophthalic acid or naphthalenedicarboxylic acid and the aromatic group accounts for all the acid derivatives in a proportion of 90 mol % or more, taking into account low temperature fixability, heat resistance, melt-miscibility and mechanical strength.

In this embodiment, it is preferred from the standpoint of satisfaction of low temperature fixability, heat resistance and melt-miscibility that the alcohol derivatives constituting the amorphous polyester resin comprise the same straight-chain aliphatic group as the $C_6$-$C_{12}$ which is a main component of the alcohol derivatives constituting the crystalline polyester resin, the straight-chain aliphatic component account for all the alcohol derivatives in a proportion of from 10 to 30 mol %, the acid derivatives constituting the amorphous polyester resin comprise the same aromatic group as the aromatic group derived from terephthalic acid, isophthalic acid or naphthalenedicarboxylic acid which is a main component of the acid derivatives constituting the crystalline polyester resin and the aromatic component account for all the acid derivatives in a proportion of 90 mol % or more.

In an embodiment in which as a third component of the crystalline polyester resin there is incorporated an aromatic component which is an alcohol derivative, it is preferred from the standpoint of melt-miscibility, heat resistance and low temperature fixability that the alcohol derivatives constituting the crystalline polyester resin comprise $C_6$-$C_{12}$ straight-chain aliphatic components and aromatic diol derivatives, the straight-chain aliphatic components and the aromatic diol derivatives account for all the alcohol derivatives in a proportion of from 85 to 98 mol % and from 2 to 15 mol %, respectively, the alcohol derivatives constituting the amorphous polyester resin comprise the same straight-chain aliphatic components and aromatic diol derivatives as the main component of the alcohol derivatives constituting the crystalline polyester resin and the straight-chain aliphatic components and the aromatic diol derivatives account for all the alcohol derivatives in a proportion of from 10 to 30 mol % and from 70 to 90 mol %, respectively.

Further, in order that the two resins might be more fairly melt-mixed with each other to provide a toner-receiving layer 1*c* having a smooth and glossy surface, the acid derivatives constituting the crystalline polyester resin and the amorphous polyester resin may be mainly composed of the same aromatic component.

Moreover, in order that the toner-receiving layer 1*c* fixed might be solidified at a higher rate, the toner-receiving layer preferably contains an inorganic particulate material in an amount of from 3 to 15% by weight. When the content of the inorganic particulate material falls below 3% by weight, little or no effect of raising the solidifying rate can be exerted. On the contrary, when the content of the inorganic particulate material exceeds 15% by weight, the viscosity during fixing is too high to provide the image with a desired high gloss surface.

A preferred embodiment of the inorganic particulate material is titanium dioxide or silica having a particle diameter of from 8 to 200 nm, which can expedite solidification without impairing whiteness even when used in a small amount.

Also, the toner-receiving layer 1*c* may be formed by a thermoplastic resin having a glass transition temperature (Tg) of not lower than 50° C. When Tg of the thermoplastic resin falls below 50° C., sheets of the image support 1 are bonded to each other during storage, leading to double feed of papers at the image support supplying step 4.

Further, from the standpoint of assurance of heat resistance of toner-receiving layer 1*c*, the viscosity of the thermoplastic resin at the upper limit of fixing temperature is preferably $10^4$ Pa·s or less. When the viscosity of the thermoplastic resin exceeds the above defined range, the step in the image on the toner-receiving layer 1*c* (difference in height of colored toner between image area and non-image area) becomes remarkable.

From the standpoint of enhancement of solidification rate of the resin after fixing, the toner-receiving layer 1*c* preferably has an inorganic particulate material dispersed in a thermoplastic resin in an amount of from 3 to 15% by weight. When the amount of the inorganic particulate material to be incorporated falls below 3% by weight, little or no effect of expediting solidification can be exerted. When the amount of the inorganic particulate material to be incorporated exceeds 15% by weight, the resulting mixture exhibits too high a viscosity during fixing to form a desired high gloss image surface.

A preferred embodiment of the inorganic particulate material is titanium dioxide or silica having a particle diameter of from 8 nm to 200 nm. Such an inorganic particulate material never impairs whiteness and can expedite solidification even when incorporated in a small amount.

Moreover, the image support 1 preferably has a gelatin layer provided interposed between the light-scattering layer 1*b* and the toner-receiving layer 1*c*. In this arrangement, the uniformity in the spread of the toner-receiving layer 1*c* can be raised, making it possible to enhance the smoothness and granularity of the surface thereof to advantage.

Further, from the standpoint of enhancement of conveyability and shape maintaining effect of the image support 1, it is preferred that a polyolefin-based resin be provided on the back side of the substrate 1*a*. In this arrangement, double conveyance of the image support 1 can be prevented. At the same time, defects such as curling and cracking of toner image (colored toner image 2 and transparent toner image 3) can be suppressed.

As the colored toner for forming the colored toner image 2 on the image support 1 there is preferably used a toner prepared by a so-called emulsion polymerization method from the standpoint of assurance of transferability at the colored toner imaging step 5 or the granularity of image itself. The term "colored toner" as used herein is meant to indicate not only ordinary colored toner but also a black toner.

Further, from the standpoint of assurance of heat resistance of the colored toner image 2, the viscosity of the colored toner at the upper limit of fixing temperature is preferably $10^3$ Pa·s or more. When the viscosity of the colored toner falls below the above defined range, the colored toner image 2 at the fixing step expands (dot gain), disturbing granularity.

On the other hand, it is necessary from the standpoint of maintenance of good external appearance such as gloss and transparency and assurance of preservability that as the transparent toner for forming the transparent toner image 3 on the image support 1 there be used a thermoplastic resin having a glass transition temperature of from not lower than 50° C. to lower than 70° C.

Further, from the standpoint of preparation of good quality image, it is preferred that the transparent toner be prepared by melting toner particles having an average particle diameter of from 3 μm to 7 μm to form a film, and the film obtained by fixing the transparent toner is predetermined to have a thickness of from 2 μm to 10 μm on the non-image area.

Moreover, from the standpoint of assurance of heat resistance of the toner image 3, the viscosity of the thermoplastic resin in the transparent toner at the upper limit of fixing temperature is preferably $10^4$ Pa·s or less. When the viscosity of the thermoplastic resin exceeds $10^4$ Pa·s, the resulting image shows remarkable steps, deteriorating the gloss in the halftone area. Further, as the transparent toner there is preferably used a toner prepared by a so-called emulsion polymerization method from the standpoint of assurance of transparency at the transparent toner imaging step 6 or the granularity of image itself as in the colored toner.

Moreover, from the standpoint of preparation of a good quality image, the transparent toner image 3 is preferably formed over the entire surface of the image forming area on the image support 1. By forming the transparent toner image 3 over the entire surface of the image forming area on the image support 1, a smooth surface can be realized. The expansion of the colored image 2 on the highlight area and the halftone area can be suppressed, making it possible to eliminate granularity.

Moreover, from the standpoint of reduction of cost, in the case where the percent coverage of colored toner image 2 in the image-forming area is great, adjustment is preferably made such that the thickness of the transparent toner image 3 is reduced. By varying the thickness of the transparent toner image 3 depending on the percent coverage of colored toner image 2, the amount of the transparent toner to be used can be reduced and the occurrence of image steps can be eliminated.

Further, the invention can be applied not only to the aforementioned image forming method but also to image-forming apparatus using same.

In this case, as shown in FIG. 2, the image-forming apparatus of the invention may comprise an image support 1 having on a substrate 1*a* a light-scattering layer 1*b* containing a white pigment and a thermoplastic resin made of a polyolefin-based resin and a toner-receiving layer 1*c* containing: a thermoplastic resin made of a mixture of a crystalline resin and an amorphous resin provided on the surface side of the light-scattering layer 1*b*; or a thermoplastic resin that comprises an amorphous resin as a main component and has a glass transition temperature of not lower than 50° C. provided on the surface side of the light-scattering layer 1*b*, a colored toner imaging unit 7 for forming a colored toner image 2 on the image support 1 with a colored toner containing a thermoplastic resin and a transparent toner imaging unit 8 for forming a transparent toner image 3 on the image support 1 having a colored toner image 2 formed thereon with a transparent toner comprising a thermoplastic resin having a glass transition temperature of from not lower than 50° C. to lower than 70° C.

In this case, the colored toner imaging unit 7 and the transparent toner imaging unit 8 each are provided with a fixing unit. The two toner imaging units perform fixing separately or altogether. From the standpoint of suppression of dot gain of the colored toner image 2 and simplification of the apparatus, the colored toner imaging unit 7 and the transparent toner imaging unit 8 preferably perform fixing altogether using the same fixing unit.

In a further embodiment of the image-forming apparatus, it is preferred that the colored toner imaging unit 7 and the transparent toner imaging unit 8 comprise a single or a plurality of image carriers for forming and supporting a colored toner image 2 and a transparent toner image 3 thereon, an intermediate transferring material for temporarily supporting and conveying the toner image on the image carriers, a primary transferring device for transferring the toner image from the image carriers onto the intermediate transferring material and a secondary transferring device for transferring the toner images together from the intermediate transferring material onto the image support 1 and the formation of a transparent toner image 3 on the surface of the intermediate transferring material be followed by the formation of a colored toner image 2.

In this arrangement, the formation of the transparent toner image 3 on the intermediate transferring material can be followed by the formation of the colored toner image 2 on the transparent toner image 3, making it possible to enhance the efficiency of transfer of the colored toner image 2 during bloc transfer and keep the granularity, particularly on the halftone area, good. The term "single or a plurality of image carriers" as used herein is meant to indicate that the imaging process with the present image-forming apparatus include both so-called rotary process (plural cyclic process) and so-called tandem process.

Figure 1A:
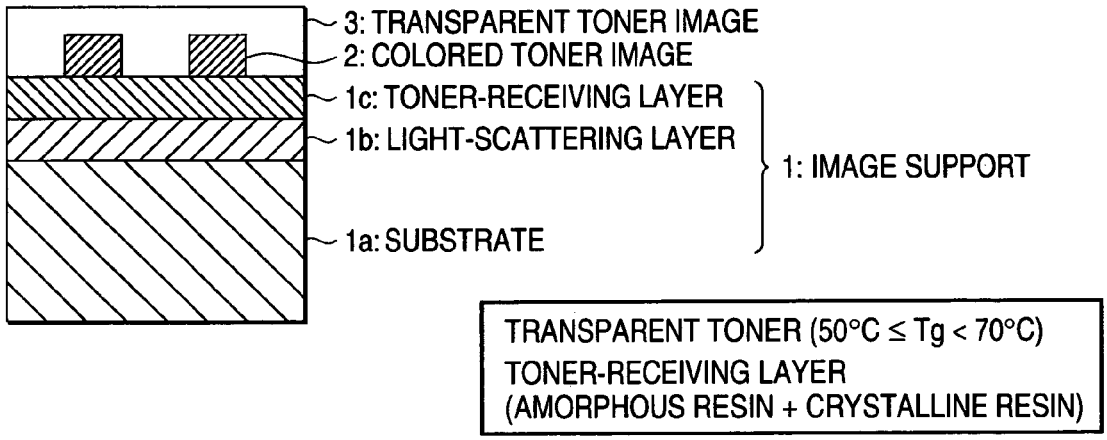
FIGS. 1A, 1B and 1C each are a diagram illustrating an outline of the image forming method according to the invention.
Figure 1B:
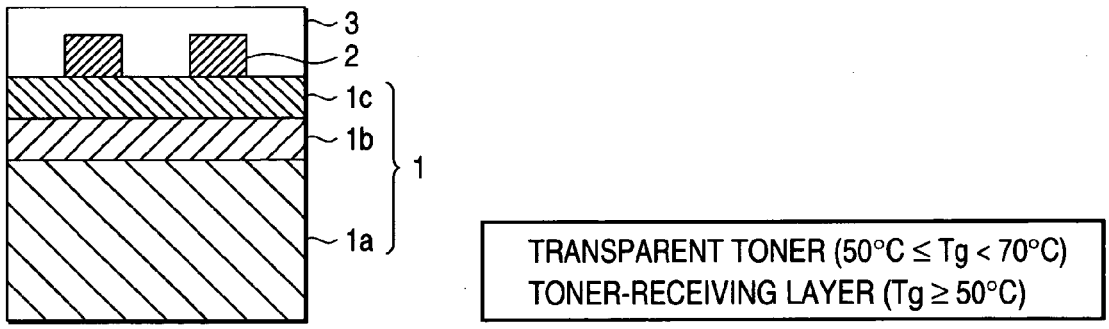
Figure 1C:
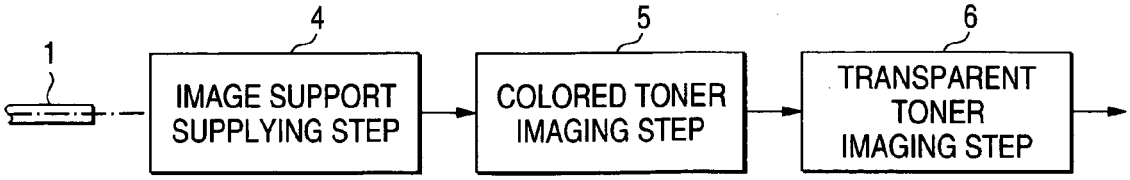

According to an embodiment of the present invention, as shown in FIGS. 1A and 1C, the invention comprises an image support supplying step 4 of supplying an image support 1 onto an imaging site, the image support 1 comprising, on a substrate 1*a*, a light-scattering layer 1*b* containing a white pigment and a thermoplastic resin made of a polyolefin-based resin and a toner-receiving layer 1*c* containing a thermoplastic resin made of a mixture of a crystalline resin and an amorphous resin provided on the surface side of the light-scattering layer 1*b*, a colored toner imaging step 5 of forming a colored toner image 2 on the image support 1 with a colored toner containing a thermoplastic resin and a transparent toner imaging step 6 of forming a transparent toner image 3 on the image support 1 having a colored toner image 2 formed thereon with a transparent toner comprising a thermoplastic resin having a glass transition temperature of from not lower than 50° C. to lower than 70° C.

Further, as shown in FIGS. 1B and 1C, the invention comprises an image support supplying step 4 of supplying an image support 1 onto an imaging site, the image support 1 comprising on a substrate 1*a* light-scattering layer 1*b* containing a white pigment and a thermoplastic resin made of a polyolefin-based resin and a toner-receiving layer 1*c* containing a thermoplastic resin that comprises an amorphous resin as a main component and has a glass transition temperature of not lower than 50° C. provided on the surface side of the light-scattering layer 1*b*, a colored toner imaging step 5 of forming a colored toner image 2 on the image support 1 with a colored toner containing a thermoplastic resin and a transparent toner imaging step 6 of forming a transparent toner image 3 on the image support 1 having a colored toner image 2 formed thereon with a transparent toner comprising a thermoplastic resin having a glass transition temperature of from not lower than 50° C. to lower than 70° C.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

The entire disclosure of Japanese Patent Application No. 2005-241871 filed on Aug. 23, 2005 and Japanese Patent Application No. 2005-241876 filed on Aug. 23, 2005 including specifications, claims, drawings and abstracts is incorporated herein by reference in its entirety.

What is claimed is:

1. An image forming method comprising:

supplying an image support onto an imaging site, the image support comprising:

a substrate;

a light-scattering layer containing a white pigment and a first thermoplastic resin comprising a polyolefin-based resin; and a toner-receiving layer containing a second thermoplastic resin comprising a mixture of a crystalline resin and an amorphous resin, in this order;

forming a colored toner image on the image support with a colored toner containing a third thermoplastic resin; and forming a transparent toner image on the image support having the colored toner image formed thereon with a transparent toner containing a fourth thermoplastic resin having a glass transition temperature of from not lower than about 50° C. to lower than about 70° C. and fixing the transparent toner to form a film.

2. The image forming method according to claim 1,
wherein the transparent toner image is prepared by melting toner particles having an average particle diameter of from about 3 μm to about 7 μm to form a film, and
wherein the film obtained by fixing the transparent toner is predetermined to have a thickness of from about 2 μm to about 10 μm on a non-image area.

3. The image forming method according to claim 1,
wherein both the colored toner and the transparent toner are prepared by emulsion polymerization method, the emulsion polymerization method comprising aggregating emulsion particles and heating the aggregated particles so that they are coalesced to each other.

4. The image forming method according to claim 1,
wherein the transparent toner image is formed over an entire surface opposite to the substrate of the image support.

5. The image forming method according to claim 4,
wherein when a percent coverage of the colored toner image on the image support is great, a thickness of the transparent toner image is reduced.

6. The image forming method according to claim 1,
wherein a viscosity of the polyolefin-based resin in the light-scattering layer at a limit of fixing temperature is about $5\times10^3$ Pa·s or more, a viscosity of the second thermoplastic resin in the toner-receiving layer at a limit of fixing temperature is about $10^3$ Pa·s or less, and a viscosity of the fourth thermoplastic resin in the transparent toner image at a limit of fixing temperature is about $10^4$ Pa·s or less.

7. The image forming method according to claim 6,
wherein a viscosity of the third thermoplastic resin in the colored toner image at a limit of fixing temperature is about $10^3$ Pa·s or more.

8. The image forming method according to claim 1,
wherein the image support further comprises a polyolefin-based resin layer provided on a back side of the substrate.

9. The image forming method according to claim 1,
wherein the second thermoplastic resin in the toner-receiving layer is a resin obtained by melting and mixing a crystalline polyester resin and an amorphous polyester resin at a weight ratio of from about 35:65 to about 65:35.

10. The image forming method according to claim 9,
wherein conditions of the melting and mixing are predetermined such that T (° C.) is from about $T_0$ to about $T_0$+20 and t is from about $t_0$ to about $10\times t_0$, in which $T_0$ represents a temperature at which a luminous reflectance Y of a 20 μm thick sheet formed of a resin obtained by melting and mixing a crystalline polyester resin and an amorphous polyester resin for a period of time to (minute) is 1.5%; T represents a temperature of melting and mixing; and t represents a time of melting and mixing (minute).

11. The image forming method according to claim 10,
wherein the temperature T (° C.) and the time t (minute) are predetermined to be from about $T_0$+5 to about $T_0$+10 and from about $t_0$ to about $3\times t_0$, respectively.

12. The image forming method according to claim 9,
wherein the crystalline polyester resin and the amorphous polyester resin comprise common alcohol derivatives or acid derivatives.

13. The image forming method according to claim 12,
wherein the alcohol derivatives in the crystalline polyester resin mainly comprise a $C_6$-$C_{12}$ straight-chain aliphatic group, and the straight-chain aliphatic group component has a proportion of from about 85 to about 98 mol % based on all the alcohol derivatives, and
wherein the acid derivatives in the crystalline polyester resin mainly comprise an aromatic group derived from terephthalic acid, isophthalic acid or naphthalenedicarboxylic acid, and the aromatic group component has a proportion of about 90 mol % or more based on all the acid derivatives.

14. The image forming method according to claim 13,
wherein the alcohol derivatives in the amorphous polyester resin comprise the same straight-chain aliphatic group as the $C_6$-$C_{12}$ straight-chain aliphatic group which is a main component of the alcohol derivatives in the crystalline polyester resin, and the straight-chain aliphatic group component has a proportion of from about 10 to about 30 mol % based on all the alcohol derivatives, and
wherein the acid derivatives in the amorphous polyester resin comprise the same aromatic group as the aromatic group derived from terephthalic acid, isophthalic acid or naphthalenedicarboxylic acid which is a main component of the acid derivatives in the crystalline polyester resin, and the aromatic group component has a proportion of about 90 mol % or more based on all the acid derivatives.

15. The image forming method according to claim 14,
wherein the alcohol derivatives in the crystalline polyester resin comprise a $C_6$-$C_{12}$ straight-chain aliphatic group and aromatic diol derivatives, and the straight-chain aliphatic group component and the aromatic diol derivatives have proportions of from about 85 to about 98 mol % and from about 2 to about 15 mol %, respectively based on all the alcohol derivatives, and
wherein the alcohol derivatives in the amorphous polyester resin comprise the same straight-chain aliphatic group component and aromatic diol derivatives as the main component of the alcohol derivatives in the crystalline polyester resin, and the straight-chain aliphatic group component and the aromatic diol derivatives have proportions of from about 10 to about 30 mol % and from about 70 to about 90 mol %, respectively based on all the alcohol derivatives.

16. The image forming method according to claim 13,
wherein the acid derivatives in the crystalline polyester resin and the amorphous polyester resin mainly comprise the same aromatic component.

17. The image forming method according to claim 1, wherein the toner-receiving layer contains an inorganic particulate material in an amount of from about 3 to about 15% by weight.

18. The image forming method according to claim 1,
wherein the image support further comprises a gelatin layer between the light-scattering layer and the toner-receiving layer.

19. An image forming method comprising:
supplying an image support onto an imaging site, the image support comprising:
a substrate;
a light-scattering layer containing a white pigment and a first thermoplastic resin comprising a polyolefin-based resin; and
a toner-receiving layer comprising a fifth-second thermoplastic resin that comprises an amorphous resin as a main component and has a glass transition temperature of 50° C. or more, in this order;
forming a colored toner image on the image support with a colored toner containing a third thermoplastic resin; and forming a transparent toner image on the image support having the colored toner image formed thereon with a transparent toner containing a fourth thermoplastic resin having a glass transition temperature of from not lower than about 50° C. to lower than about 70° C. and fixing the transparent toner to form a film.

20. The image forming method according to claim 19, wherein the transparent toner image is prepared by melting toner particles having an average particle diameter of from about 3 μm to about 7 μm to form a film, and wherein the film obtained by fixing the transparent toner is predetermined to have a thickness of from about 2 μm to about 10 μm on a non-image area.

21. The image forming method according to claim 19, wherein both the colored toner and the transparent toner are prepared by an emulsion polymerization method, the emulsion polymerization method comprising aggregating emulsion particles and heating the aggregated particles so that they are coalesced to each other.

22. The image forming method according to claim 19, wherein the transparent toner image is formed over an entire surface opposite to the substrate of the image support.

23. The image forming method according to claim 22, wherein when a percent coverage of the colored toner image on the image support is great, a thickness of the transparent toner image is reduced.

24. The image forming method according to claim 19, wherein a viscosity of the polyolefin-based resin in the light-scattering layer at a limit of fixing temperature is about $5\times10^3$ Pa·s or more, a viscosity of the fifth thermoplastic resin in the toner-receiving layer at a limit of fixing temperature is about $10^4$ Pa·s or less, and the fourth thermoplastic resin in the transparent toner image at a limit of fixing temperature is about $10^4$ Pa·s or less.

25. The image forming method according to claim 24, wherein a viscosity of the third thermoplastic resin in the colored toner image at a limit of fixing temperature is about $10^3$ Pa·s or more.

26. The image forming method according to claim 19, wherein the image support further comprises a polyolefin-based resin layer provided on a back side of the substrate.

27. The image forming method according to claim 19, wherein the image support further comprises an antistatic layer provided on at least one of the outermost surface of a back side of the substrate and a surface of a front side of the substrate.

28. The image forming method according to claim 19, wherein the image support further comprises a gelatin layer between the light-scattering layer and the toner-receiving layer.

* * * * *